US010760029B2

(12) United States Patent
Oshita et al.

(10) Patent No.: US 10,760,029 B2
(45) Date of Patent: Sep. 1, 2020

(54) WATER-BASED LUBRICATING COATING AGENT FOR METAL MATERIAL, SURFACE-TREATED METAL MATERIAL, AND METHOD FOR FORMING LUBRICATING COATING FOR METAL MATERIAL

(71) Applicant: Nihon Parkerizing Co., Ltd., Tokyo (JP)

(72) Inventors: Kenichiro Oshita, Tokyo (JP); Shinobu Komiyama, Tokyo (JP)

(73) Assignee: NIHON PARKERIZING CO., LTD., Tokyo (JP)

( * ) Notice: Subject to any disclaimer, the term of this patent is extended or adjusted under 35 U.S.C. 154(b) by 231 days.

(21) Appl. No.: 15/569,239

(22) PCT Filed: Mar. 4, 2016

(86) PCT No.: PCT/JP2016/056764
§ 371 (c)(1),
(2) Date: Oct. 25, 2017

(87) PCT Pub. No.: WO2016/174924
PCT Pub. Date: Nov. 3, 2016

(65) Prior Publication Data

US 2018/0320101 A1 Nov. 8, 2018

(30) Foreign Application Priority Data

Apr. 27, 2015 (JP) ..... 2015-090839

(51) Int. Cl.

| | |
|---|---|
| ***C10M 125/10*** | (2006.01) |
| ***C10M 173/00*** | (2006.01) |
| ***C10M 125/30*** | (2006.01) |
| ***C23C 22/47*** | (2006.01) |
| ***C10M 113/16*** | (2006.01) |

(Continued)

(52) U.S. Cl.
CPC ..... *C10M 125/10* (2013.01); *C10M 113/10* (2013.01); *C10M 113/16* (2013.01); *C10M 125/30* (2013.01); *C10M 129/34* (2013.01); *C10M 159/06* (2013.01); *C10M 173/00* (2013.01); *C23C 22/34* (2013.01); *C23C 22/47* (2013.01); *C10M 2201/02* (2013.01); *C10M 2201/062* (2013.01); *C10M 2201/08* (2013.01); *C10M 2201/085* (2013.01); *C10M 2201/087* (2013.01); *C10M 2201/103* (2013.01); *C10M 2201/14* (2013.01); *C10M 2203/10* (2013.01); *C10M 2205/14* (2013.01); *C10M 2207/123* (2013.01); *C10M 2207/124* (2013.01); *C10M 2207/283* (2013.01); *C10M 2207/40* (2013.01); *C10M 2207/402* (2013.01); *C10M 2209/084* (2013.01); *C10M 2209/104* (2013.01); *C10N 2010/02* (2013.01); *C10N 2010/04* (2013.01); *C10N 2010/08* (2013.01); *C10N 2010/12* (2013.01); *C10N 2020/06* (2013.01); *C10N 2020/061* (2020.05); *C10N 2040/20* (2013.01); *C10N 2040/245* (2020.05);
(Continued)

(58) Field of Classification Search
CPC ..... C10M 2201/1033; C10M 2201/14; C10M 2201/0663; C10M 2203/003; C10M 2203/1065; C10M 2209/1045; C10M 2207/2835; C10M 2223/0415; C10M 2207/126; C10M 2205/143; C10M 2209/109; C10N 2250/08; C10N 2010/12; C10N 2050/013
See application file for complete search history.

(56) References Cited

U.S. PATENT DOCUMENTS

| | | | |
|---|---|---|---|
| 3,409,476 | A | 11/1968 | Kussmann et al. |
| 4,532,066 | A | 7/1985 | Paszek et al. |

(Continued)

FOREIGN PATENT DOCUMENTS

| | | | |
|---|---|---|---|
| CA | 2312807 | A1 | 6/1999 |
| EP | 2620524 | A1 | 7/2013 |

(Continued)

OTHER PUBLICATIONS

International Search Report issued in PCT/JP2016/056764 dated Apr. 26, 2016 (7 pages).

(Continued)

*Primary Examiner* — Vishal V Vasisth
(74) *Attorney, Agent, or Firm* — Osha Liang LLP

(57) ABSTRACT

Provided is a water-based lubricating coating agent for a metal material, capable of carrying out a chemical conversion treatment and a lubrication treatment at the same time, which makes it possible to achieve excellent lubricity even in plastic working, press molding, and the like, and at the same time, operability (e.g., process shortening, sludge reduction).

The water-based lubricating coating agent having pH of 2.0 to 6.5 for a metal material is obtained by blending: at least one lubricating component other than black-based solid lubricants; and at least one chemical conversion component selected from the group consisting of a phosphoric acid compound, an oxalic acid compound, a molybdic acid compound, a zirconium compound, and a titanium compound, the concentration of the lubricating component is 5 mass % or more in mass ratio to the total solid content mass in the lubricating coating agent, and the concentration of the chemical conversion component is 0.3 to 8 mass % when the total mass of the lubricating coating agent is regarded as 100 mass %.

12 Claims, No Drawings

(51) Int. Cl.

| | |
|---|---|
| ***C10M 113/10*** | (2006.01) |
| ***C23C 22/34*** | (2006.01) |
| ***C10M 129/34*** | (2006.01) |
| ***C10M 159/06*** | (2006.01) |
| *C10N 10/02* | (2006.01) |
| *C10N 10/04* | (2006.01) |
| *C10N 10/08* | (2006.01) |
| *C10N 10/12* | (2006.01) |
| *C10N 20/06* | (2006.01) |
| *C10N 20/00* | (2006.01) |
| *C10N 40/20* | (2006.01) |
| *C10N 50/02* | (2006.01) |
| *C10N 50/00* | (2006.01) |

(52) U.S. Cl.
CPC .. *C10N 2040/246* (2020.05); *C10N 2040/247* (2020.05); *C10N 2050/02* (2013.01); *C10N 2050/023* (2020.05)

(56) References Cited

U.S. PATENT DOCUMENTS

| | | | | |
|---|---|---|---|---|
| 2003/0130139 | A1* | 7/2003 | Komiyama | C10M 141/00 508/161 |
| 2004/0255818 | A1 | 12/2004 | Pawloski | |
| 2005/0119133 | A1* | 6/2005 | Komiyama | C10M 169/04 508/100 |
| 2005/0147832 | A1 | 7/2005 | Okai et al. | |
| 2005/0209102 | A1 | 9/2005 | Sasaki et al. | |
| 2013/0171468 | A1 | 7/2013 | Imokawa et al. | |
| 2014/0162917 | A1* | 6/2014 | Komiyama | C10M 103/06 508/175 |

FOREIGN PATENT DOCUMENTS

| | | | |
|---|---|---|---|
| GB | 1508484 | A | 4/1978 |
| JP | S51-94436 | A | 8/1976 |
| JP | S53-053465 | U | 5/1978 |
| JP | H05-246777 | A | 9/1993 |
| JP | 2003-166073 | A | 6/2003 |
| JP | 2005-206947 | A | 8/2005 |
| JP | 2005-262583 | A | 9/2005 |
| JP | 2007-002330 | A | 1/2007 |
| JP | 2010-106208 | A | 5/2010 |
| JP | 2012-067369 | A | 4/2012 |
| WO | 1996/027654 | A1 | 9/1996 |
| WO | 1999/029927 | A2 | 6/1999 |
| WO | 2005/001148 | A2 | 1/2005 |
| WO | 2012/086564 | A1 | 6/2012 |

OTHER PUBLICATIONS

Written Opinion of the International Searching Authority issued in PCT/JP2016/056764 dated Apr. 26, 2016 (5 pages).
Extended European Search Report issued in European Application No. 16786201.0, dated Sep. 12, 2018 (11 pages).
International Preliminary Report on Patentability issued in International Application No. PCT/JP2016/056764; dated Nov. 9, 2017 (9 pages).

* cited by examiner

WATER-BASED LUBRICATING COATING AGENT FOR METAL MATERIAL, SURFACE-TREATED METAL MATERIAL, AND METHOD FOR FORMING LUBRICATING COATING FOR METAL MATERIAL

This application is a 371 of PCT/JP2016/056764, filed Mar. 4, 2016.

TECHNICAL FIELD

The present invention relates to a water-based lubricating coating agent for a metal material, which is capable of forming, in one step, a lubricating coating that has a two-layer structure of a chemical conversion coating for a lower layer and a lubricating coating for an upper layer at a metal material, in particular, a metal material surface such as iron and steel, stainless steel, aluminum, and magnesium, as well as techniques related thereto. More particularly, the present invention is directed to a lubricating coating agent which can be used for plastic working such as forging, wire drawing, tube drawing, and heading of the metal material, for press molding of a plate material, and in sliding parts of various devices, and further including no black-based lubricant such as molybdenum disulfide or graphite.

BACKGROUND ART

In general, in plastic working of metal materials, for the purpose of preventing from seizure and galling caused by metal contact between materials to be worked and tools, coatings that have lubricity are provided on the metal material surfaces. Such coatings include a reactive type of forming, on a metal material surface, a chemical conversion coating by chemical reaction, and then further forming a lubricating coating. For example, widely used are lubricating coatings that have a two-layer structure obtained by forming, on a metal material surface, a chemical conversion coating such as a phosphate coating (target metal: iron and steel, magnesium, and the like), an oxalate coating (target metal: iron and steel, stainless steel, and the like), or an aluminum fluoride coating (target metal: aluminum) that has a role as a carrier, and then further applying a lubricant such as a lime soap, a molybdenum disulfide, or an oil, and lubricating coatings that have a three-layer structure (chemical conversion coating/metal soap coating/unreacted soap coating) obtained by applying a chemical conversion coating, and then coating with a reactive soap such as sodium stearate. In particular, the latter lubricating coatings that have the three-layer structure are known to be capable of producing stable and excellent lubricity even in heavy working regions.

However, the chemical conversion treatment with the chemical reaction and the reactive soap require solution management, temperature management for controlling the chemical reaction, removal and disposal of sludge as a reaction by-product, and disposal renewal due to solution deterioration. For the purpose of global environmental conservation in recent years, the reduction of industrial waste has become a great problem. To that end, lubricating coating agents and treatment methods which produce no waste have been desired.

Furthermore, lubrication treatment methods provided with chemical conversion treatment steps have required a long treatment process as follows, and a lubrication treatment which has a short treatment process, and allows a short time treatment has been thus desired conventionally.

acid cleaning→first water rinsing→second water rinsing→chemical conversion treatment→first water rinsing→second water rinsing→lubrication treatment In response to the requests mentioned previously, lubricants are cited which can carry out a chemical conversion treatment and a lubrication treatment at the same time. For example, Patent Literature 1 discloses an acid lubricant containing, as its main constituents, 0.1 to 30 weight % of a water-soluble and/or water-dispersible resin, and one of emulsified and dispersed paraffins, waxes, esters of higher fatty acids, and metal soaps, or a mixture thereof in a phosphoric acid aqueous solution with a concentration of 1 to 50 weight %.

CITATION LIST

Patent Literature

Patent Literature 1: JP 51-94436 A

SUMMARY OF INVENTION

Technical Problem

However, the lubricant described in Patent Literature 1 is mainly intended for hot-rolled steel sheets, and focusing on iron oxide scale removal with phosphoric acid, rather than chemical conversion treatment. Therefore, chemical conversion coatings iron phosphate are formed on the steel sheet surfaces, but because of the extremely low pH of the lubricant, and thus the excessively strong etching action on the steel sheets, it is difficult to form dense chemical conversion coatings with excellent resistance to galling, required for plastic working and press molding.

Therefore, an object of the present invention is to provide a water-based lubricating coating agent for a metal material, capable of carrying out a chemical conversion treatment and a lubrication treatment at the same time, which makes it possible to achieve excellent lubricity even in plastic working, press molding, and the like, and at the same time, operability (e.g., process shortening, sludge reduction).

Solution to Problem

The inventors have found, as a result of earnest studies for solving the problem mentioned previously, the use of an acidic water-based lubricating coating agent including a specific lubricating component and chemical conversion component can achieve excellent lubricity and operability (e.g., process shortening, sludge reduction) at the same time, thereby leading to the completion of the present invention.

A water-based lubricating coating agent for a metal material (hereinafter, abbreviated as a lubricating coating agent) according to the present invention is an acidic lubricating coating agent obtained by blending: at least one lubricating component other than black-based solid lubricants; and a chemical conversion component derived from at least one compound selected from the group consisting of a phosphoric acid compound, an oxalic acid compound, a molybdic acid compound, a zirconium compound, and a titanium compound. The concentration of the lubricating component is 5 mass % or more, more preferably 10 mass % or more in mass ratio to the mass of the total solid content in the lubricating coating agent mentioned previously. The upper limit thereof is not particularly limited, but for example, 96 mass % or less. The concentration of the chemical conversion component is 0.3 to 8 mass %, more preferably 0.5 to 5 mass % when the total mass (including water) of the lubricating coating agent is regarded as 100 mass %. The lubricating coating agent has pH of 2.0 to 6.5, more preferably 3.0 to 6.0.

At least one selected from the group consisting of the following lipophilic lubricating component (A), a cleavage solid lubricant (B), and carrier particles (C) can be applied as the lubricating component mentioned previously.

lipophilic lubricating component (A): at least one selected from the group consisting of an oil, an extreme-pressure agent, a soap, and a wax cleavage solid lubricant (B): the following crystalline inorganic salt (B1) and/or layered clay mineral (B2)

crystalline inorganic salt (B1): at least one crystalline inorganic salt selected from the group consisting of a phosphate, a sulfate, a hydroxide, and an oxide layered clay mineral (B2): at least one layered clay mineral selected from the group consisting of natural products and synthetic products of a smectite group, a vermiculite group, a mica group, a brittle mica group, a pyrophyllite group, and a kaolinite group carrier particles (C): particles including the lipophilic lubricating component (A) between particles of and/or between layers of the layered clay mineral (B2) mentioned previously The lubricating component more preferably includes at least the carrier particles (C).

For the efficient inclusion of the lipophilic lubricating component between the particles of and/or between the layers of the layered clay mineral, the lipophilic lubricating component preferably has a solubility parameter (SP value) of 10 or less, further preferably 9 or less.

For the efficient inclusion of the lipophilic lubricating component between the particles of and/or between the layers of the layered clay mineral, the layered clay mineral is preferably 40° or more, and further preferably 60° or more in water contact angle.

For the efficient inclusion of the lipophilic lubricating component between the particles of and/or between the layers of the layered clay mineral, the layered clay mineral is preferably 30 μm or less, more preferably 20 μm or less, and further preferably 10 μm or less in average particle size (volumetric basis) obtained by a laser diffraction method.

For the efficient inclusion of the lipophilic lubricating component between the particles of and/or between the layers of the layered clay mineral, the aspect ratio in a cross section of the layered clay mineral is preferably 3 to 150, more preferably 5 to 100, further preferably 5 to 30.

In the carrier particles, the inclusion amount of the lipophilic lubricating component between the particles of and/or the layers of the layered clay mineral is preferably 5 mass % or more, and further preferably 8 mass % or more in mass ratio to the total mass of the carrier particles.

The layered clay mineral preferably has Mohs hardness of 2 or less, and further preferably 1.

Furthermore, in the lubricating coating agent according to the present invention, at least one selected from a water-based inorganic salt, a water-based organic salt, and a water-based resin can be applied as a binder component for a lubricating coating.

The problem mentioned previously can be also solved by a surface-treated metal material characterized in that the coating amount of a coating formed at a metal material surface with the lubricating coating agent according to the present invention (a chemical conversion coating on the metal material surface and a lubricating coating on the chemical conversion coating) is, as dried coating amounts, adapted such that the chemical conversion coating for a lower layer is formed to be 0.1 $g/m^2$ or more, more preferably 0.3 $g/m^2$ or more, whereas the lubricating coating for an upper layer is formed to be 0.5 $g/m^2$ or more, more preferably 3 $g/m^2$ or more.

The problem mentioned previously can be also solved by a method for forming a lubricating coating at a metal material and a method for manufacturing a surface-treated metal material, which are characterized by including a contact step of bringing a metal material surface into contact with the lubricating coating agent according to the present invention.

Effects of Invention

According to the present invention, the acidic water-based lubricating coating agent including the specific lubricating component and chemical conversion component and water, the surface-treated metal material, and the method for forming a lubricating coating for a metal material are applied, thereby making it possible to carry out, in one step, a chemical conversion treatment and a lubrication treatment at the same time, also achieving a non-black color, making it possible to produce stable and excellent lubricity even in a heavy working region, and thus prevent from seizure and galling, further making it possible to improve operability such as the reduced amount of sludge accumulated in a treatment tank, and furthermore, also achieving excellent corrosion resistance.

DESCRIPTION OF EMBODIMENTS

The present invention will be described in more detail. A lubricating coating agent according to the present invention is an acidic water-based lubricating coating agent which is capable of forming, in one step, a chemical conversion coating for a lower layer and a lubricating coating for an upper layer, characterized in that the lubricating coating agent includes specific lubricating component and chemical conversion component, and has pH of 2.0 to 6.5.

First, a chemical conversion reaction in the lubricating coating agent according to the present invention will be described. The coating formation mechanism of a common chemical conversion treatment is that when a metal material is brought into contact with a chemical conversion treatment agent, the metal material surface is etched (dissolved) by $H^+$ ions as an acid component (etching component) in the chemical conversion treatment agent, thereby increasing the pH near the surface. The increased pH near the surface insolubilizes ions derived from the chemical conversion component present near the surface (anions and cations produced by ionization of compounds such as phosphoric acid compounds as described later), thereby an insolubilized product as a chemical conversion coating being formed on the metal material surface. The same applies to the lubricating coating agent according to the present invention regarding the formation mechanism of chemical conversion coating.

In the lubricating coating agent according to the present invention, at least one selected from the group consisting of a phosphoric acid compound, an oxalic acid compound, a molybdic acid compound, a zirconium compound, and a titanium compound can be used as the chemical conversion component.

The chemical conversion component will be described in more detail. The phosphoric acid compound for use in the lubricating coating agent according to the present invention is a soluble primary phosphate ($Me(H_2PO_4)_n$), and at least one selected from the group consisting of $Zn^{2+}$, $Ni^{2+}$, $Mn^{2+}$, $Ca^{2+}$, $Co^{2+}$, $Mg^{2+}$, $Al^{3+}$, $Na^{+}$, $K^{+}$, and $NH_4^{+}$ can be applied for $Me^{n+}$ as a cation.

The chemical conversion coating formed from the primary phosphate is a poorly-soluble tertiary phosphate, and specifically, examples of the tertiary phosphate include $Zn_3(PO_4)_2$, $Zn_2Fe(PO_4)_2$, $Zn_2Ni(PO_4)_2$, $Mn_3(PO_4)_2$, $Zn_2Mn(PO_4)_2$, $Mn_2Fe(PO_4)_2$, $Ca_3(PO_4)_2$, $Zn_2Ca(PO_4)_2$, and $FePO_4$. In this regard, a chemical conversion coating of $FePO_4$ is formed when a metal material as a material is an iron-based material, and when at least one primary phosphate selected from the group consisting of a primary sodium phosphate, a primary potassium phosphate, and a primary ammonium phosphate is adapted as a chemical conversion component. More specifically, when the metal material as a material is an iron-based material including at least iron, iron ions eluted by an acid component (etching component) are supposed to react directly with primary phosphate ions to form $FePO_4$, and the supply source for the iron ions is iron as a material. It is to be noted that the term of poor solubility is defined as a solubility of less than 0.2 g/100 g in water.

When the chemical conversion component is an oxalic acid compound, the use of an iron-based material as a metal material causes iron ions eluted by an acid component to react directly with oxalate ions, thereby forming a poorly-soluble iron oxalate as a chemical conversion coating. While the oxalic acid compound is not particularly limited as long as the compound is a soluble oxalate, at least one selected from the group consisting of an oxalic acid, a sodium oxalate, a potassium oxalate, and an ammonium oxalate, and the like can be used.

When the chemical conversion component is a molybdic acid compound, a chemical conversion coating composed of a mixture of iron molybdate and molybdenum oxide is formed when an iron-based material is used as a metal material. While the molybdic acid compound is not particularly limited as long as the compound is a soluble molybdate, at least one selected from the group consisting of, for example, a molybdic acid, a sodium molybdate, a potassium molybdate, and an ammonium molybdate, and the like can be used.

When the chemical conversion component is a zirconium compound, specifically, at least one selected from the group consisting of inorganic acid salts such as a fluorozirconic acid and a zirconium nitrate, and organic acid salts such as a zirconium acetate and a zirconium lactate can be used. The chemical conversion coating formed in this case is a mixture of zirconium oxide and zirconium hydroxide.

When the chemical conversion component is a titanium compound, specifically, at least one selected from the group consisting of inorganic acid salts such as a fluorotitanic acid and a titanium nitrate, and organic acid salts such as a titanium acetate and a titanium citrate can be used. The chemical conversion coating formed in this case is a mixture of titanium oxide and titanium hydroxide.

For the formation of a chemical conversion coating that has excellent lubricity, the concentration and pH of the chemical conversion component are important. The concentration of the chemical conversion component is preferably 0.3 to 8 mass %, more preferably 0.5 to 5 mass % when the total mass (including water) of the lubricating coating agent according to the present invention is regarded as 100 mass %. When the concentration of the chemical conversion component falls below 0.3 mass %, the decreased reactivity may reduce the coating amount of the chemical conversion coating, thereby deteriorating the lubricity. When the concentration of the chemical conversion component exceeds 8 mass %, the coating amount of the chemical conversion coating is sufficient, but operational problems may be caused, such as an increased amount of sludge generated. The adjustment of the concentration of the chemical conversion component to 0.5 mass % or more can further enhance the lubricity of the chemical conversion coating, and the adjustment thereof to 5 mass % or lower can suppress the generation of sludge in a more reliable manner.

In the lubricating coating agent according to the present invention, a preferred pH range is 2.0 to 6.5, more preferably 3.0 to 6.0. When the pH falls below 2.0, the etching ability for a metal material surface is excessive thereby making a uniform chemical conversion coating less likely to be formed, and there is a possibility of decreasing the lubricity or increasing the amount of sludge generated. On the other hand, the pH in excess of 6.5 makes it impossible to ensure the etching amount required for the chemical conversion reaction, thus making a chemical conversion coating less likely to be formed, and the lubricity may be decreased. The adjustment of the pH range to 3.0 to 6.0 can ensure a more preferred etching ability, and thus further enhance the lubricity. In addition, the acid and alkali components for adjusting the pH is not particularly limited, but in the case of any chemical conversion component, it is preferable to use, as the alkali component, at least one selected from sodium hydroxide, potassium hydroxide, ammonia, and amines. As the acid component, it is preferable to use a phosphoric acid in accordance with the chemical conversion component when the chemical conversion component is a phosphoric acid compound, and likewise, it is preferable to use an oxalic acid when the chemical conversion component is an oxalic acid. When the chemical conversion component is a molybdic acid compound, it is preferable to use an organic acid such as a tartaric acid, a citric acid, and an acetic acid. In the case of a zirconium compound, as well as a titanium compound, it is preferable to use an organic acid such as a tartaric acid, a citric acid, and an acetic acid, or a hydrofluoric acid. It is to be noted that the chemical conversion component according to the present invention is considered to include these pH adjusters also in addition to the previously mentioned chemical conversion component (at least one selected from the group consisting of a phosphoric acid compound, an oxalic acid compound, a molybdic acid compound, a zirconium compound, and a titanium compound).

For the chemical conversion component mentioned previously, compounds more preferred when the metal material as a material is an iron-based material include at least one phosphoric acid compound selected from the group consisting of a primary sodium phosphate, a primary potassium phosphate, and a primary ammonium phosphate, an oxalic acid, and at least one molybdic acid compound selected from the group consisting of a sodium molybdate, a potassium molybdate, and an ammonium molybdate. The reason will be mentioned below.

First, the reason why the previously mentioned chemical conversion component (at least one phosphoric acid compound selected from the group consisting of a primary sodium phosphate, a primary potassium phosphate, and a primary ammonium phosphate, an oxalic acid, and at least one molybdic acid compound selected from the group consisting of a sodium molybdate, a potassium molybdate, and an ammonium molybdate) is preferred will be described in terms of operability (sludge reduction). It is to be noted that in the following description, cases of using an iron-based material as a metal material for a material will be explained as examples. When at least one phosphoric acid compound selected from a primary sodium phosphate, a primary potassium phosphate, and a primary ammonium phosphate is used as the chemical conversion component, iron ions eluted from iron as a material by etching react immediately with the phosphoric acid compound mentioned previously, thereby turning into a chemical conversion coating of iron phosphate ($FePO_4$). For this reason, almost no sludge is generated because almost no iron is eluted into the lubricating coating agent. Also when an oxalic acid, a sodium molybdate, a potassium molybdate, or an ammonium molybdate is used as the chemical conversion component, in the same manner as mentioned previously, eluted iron ions react immediately with the chemical conversion component, thereby turning into a chemical conversion coating, and thus resulting in almost no iron eluted in the lubricating coating agent, or almost no sludge generated. On the other hand, in the case of other phosphoric acid compounds, zirconium compounds, and titanium compounds, the amount of eluted iron ions incorporated in the chemical conversion coating is, although slightly, smaller as compared with the more preferred chemical conversion component mentioned previously, and the iron ions that are not incorporated in the chemical conversion coating thus turns into sludge as an iron phosphate or an iron hydroxide in the lubricating coating agent. However, as compared with the case of phosphate treatment according to the prior art, the amount of sludge is smaller, which never reaches any operationally problematic level.

Next, the reason why the previously mentioned chemical conversion component (at least one phosphoric acid compound selected from the group consisting of a primary sodium phosphate, a primary potassium phosphate, and a primary ammonium phosphate, an oxalic acid, and at least one molybdic acid compound selected from the group consisting of a sodium molybdate, a potassium molybdate, and an ammonium molybdate) is preferred will be described in terms of the function of the chemical conversion coating. As mentioned previously, the chemical conversion coating formed from at least one phosphoric acid compound selected from a primary sodium phosphate, a primary potassium phosphate, and a primary ammonium phosphate is an iron phosphate ($FePO_4$). The chemical conversion coating of iron phosphate is higher in coatability as compared with other phosphate coatings, and the iron phosphate is thus superior in corrosion resistance, with lubricity at a level equivalent to other phosphates. In addition, it is more possible to increase the thickness of the chemical conversion coating of iron oxalate formed from an oxalic acid, than other chemical conversion coatings, and the chemical conversion coating of iron oxalate is superior in lubricity as is the case in the iron phosphate coating. A chemical conversion coating of mixed iron molybdate and molybdenum oxide is obtained from at least one chemical conversion component selected from the group consisting of a sodium molybdate, a potassium molybdate, and an ammonium molybdate. This chemical conversion coating is superior particularly in corrosion resistance to other chemical conversion coatings, due to the oxidizing action of the molybdic acid included in the chemical conversion coating. It is for the foregoing reasons that the iron phosphate coating, the iron oxalate coating, and the coating composed of iron molybdate and molybdenum oxide are particularly preferred as the chemical conversion coating.

When the metal material as a material is a metal material other than iron-based materials (e.g., aluminum or magnesium), the coating amount required for the achievement of favorable lubricity is not obtained even with the use of, as the chemical conversion component, at least one primary phosphate selected from the group consisting of a primary sodium phosphate, a primary potassium phosphate, and a primary ammonium phosphate and at least one oxalic acid compound selected from the group consisting of an oxalic acid, a sodium oxalate, a potassium oxalate, an ammonium oxalate, and the like, because few iron ions are supplied from the material. Therefore, there is a need to use a chemical conversion component other than the foregoing chemical conversion components, more preferred chemical conversion components are molybdic acid compounds, zirconium compounds, and titanium compounds.

For the purposes of causing the chemical conversion reaction to proceed in a more efficient manner and forming a highly lubricant chemical conversion coating, and furthermore, as a reaction accelerator, an oxidant may be added to the lubricating coating agent. Thus, uniform chemical conversion coatings can be formed even with poorly chemically converted materials which are less likely to be etched. The type of the oxidant is not particularly limited, but at least one selected from bromates, molybdates, hydrogen peroxide, nitrites, ferric nitrate, and the like can be used. In addition, the oxidant concentration in the lubricating coating agent is preferably 0.01 to 0.5 mass % when the total mass (including water) of the lubricating coating agent is regarded as 100 mass %.

Next, the lubricating component in the lubricating coating agent according to the present invention will be described. First, a first lubricating component that can be used for the lubricating coating agent according to the present invention is at least one lipophilic lubricating component selected from the group consisting of an oil, an extreme-pressure agent, a soap, and a wax. The lipophilic lubricating component can be referred to also as a sort of lipophilic organic lubricating component.

In the lipophilic lubricating component, at least one selected from the group consisting of mineral oils, animal and plant oils, and synthetic oils can be used as the oil. More specifically, for example, naphthenic mineral oil or paraffinic mineral oil-based machine oils, turbine oils, spindle oils, and the like can be used as the mineral oils. For example, palm oils, rapeseed oils, coconut oils, castor oils, beef tallow, pork oils, whale oils, fish oils, or these components with ethylene oxide added thereto (for example, polyoxyethylene castor oils (ethylene oxide adducts)) can be used as the animal and plant oils. Ester oils (for example, esters of polyhydric alcohols such as ethylene glycol and trimethylolpropane and fatty acids such as stearic acid, oleic acid, and linoleic acid (e.g., trimethylolpropane trioleate)), silicone oils (for example, polydimethylsiloxane and polydiphenylsiloxane), and the like can be used as the synthetic oils. Hydrophobic organic compounds (for example, organic ammonium compounds, organic phosphonium compounds, organic sulfonium compounds, organic amine compounds) can be also used as synthetic oils for the lipophilic lubricating component according to the present invention. The naphthenic mineral oils are preferred as the mineral oils; the palm oils and the castor oils of the plant oils, and the oils with ethylene oxide added thereto (polyoxyethylene plant oils (ethylene oxide adducts)) are preferred as the animal and plant oils; and the ester oils (trimethylolpropane trioleate) are preferred as the synthetic oils.

An agent that effectively develops an extreme-pressure effect at the friction surface between a metal material and a tool during working is preferred as the extreme-pressure agent. Examples of such an extreme-pressure agent can include sulphurized olefins, sulfurized esters, sulphites, thiocarbides, phosphate esters, phosphite esters, molybdenum dithiocarbamate (MoDTC), molybdenum dithiophosphate (MoDTP), zinc dithiophosphate (ZnDTP), and tricresyl phosphate, and the phosphates (tricresyl phosphate) are preferred. According to the present invention, while it is also possible to use the oil and the extreme-pressure agent each alone, it is preferable to use the oil and the extreme-pressure agent in combination in order to achieve higher lubricity. In this case, the ratio between the oil and the extreme-pressure agent preferably falls within the range of 1:0.03 to 1:1 in mass ratio. When the ratio between the oil and the extreme-pressure agent is 1:0.03 to 1:1 in mass ratio, the lubricity is further improved with an extreme-pressure action imparted. When the ratio between the oil and the extreme-pressure agent exceeds 1:1, the extreme-pressure action is nearly saturated.

Furthermore, the previously mentioned oil and extreme-pressure agent may be blended with a viscosity index improver for the purpose of achieving higher lubricity. Specifically, at least one viscosity index improver selected from polymethacrylates, olefin copolymers, and polyisobutylenes can be used. The viscosity index (JIS K2283) is preferably 100 or more, and more preferably 200 or more.

It is preferable to use, as the soap, an alkali metal salt of a fatty acid (such as stearic acid, myristic acid, palmitic acid) having 12 to 26 carbon atoms, or a metal soap obtained by reacting a fatty acid (such as stearic acid, myristic acid, palmitic acid) having 12 to 26 carbon atoms and at least one metal selected from zinc, calcium, barium, aluminum, and magnesium. In addition, the soap preferably has a melting point of 100 to 250° C. An alkali metal salt of a stearic acid and a metal soap (zinc stearate) obtained by reacting a fatty acid having 12 to 26 carbon atoms and zinc are more preferred as the soap.

The wax is not to be considered particularly specified in terms of structure and type, but preferably has a melting point of 70 to 150° C., because the wax is melted by heat generated during working, thereby developing lubricity. Waxes that have a melting point in this range include, for example, microcrystalline waxes, polyethylene waxes, polypropylene waxes, and carnauba waxes, and polyethylene waxes are preferred.

Next, a second lubricating component that can be used for the lubricating coating agent according to the present invention is a cleavage solid lubricant (hereinafter, simply referred to as a "solid lubricant"). According to Solid Lubrication Handbook (Japanese Society of Tribologists: Yokendo Co., Ltd. (2009) 53), the solid lubricant refers to a matter interposed between two objects for purposes such as friction reduction, seizure prevention, and improved mold life when the objects cause relative movement. In general, the solid lubricant is used as one component of a lubricating coating for plastic working, sliding members, press molding, and the like, and specifically, layered clay minerals, crystalline inorganic salts, polymer materials, soft metals, and the like are applied as the solid lubricant.

Examples of the solid lubricant mentioned previously, which can be used for the present invention, include inorganic salts with crystallinity (crystalline inorganic salts), that is, phosphates, sulfates, hydroxides such as zinc hydroxides and calcium hydroxides, and oxides such as zinc oxides and calcium oxides, and layered clay minerals that have a layered crystal structure, other than black-based solid lubricants (the L value in the L*a*b color system (JIS Z-8729) of a solid lubricant alone is 30 or less, which is measured with a color computer, with a petri dish (internal diameter: 85.5 mmφ, height: 20 mm) filled with a solid lubricant powder through a sieve opening of 300 μm in mesh size) as typified by molybdenum disulfide and graphite. These are all cleavage solid lubricants. The cleavage refers to the property of splitting and fracturing at a crystal face with the weakest atomic bonding force when a load is applied to a solid lubricant. This property causes, in plastic working, the solid lubricant to follow effectively to an area expansion of the worked surface during the working, thereby imparting slidability, and at the same time, preventing from galling. The previously mentioned solid lubricant can be also referred to as a sort of solid inorganic lubricant, a cleavage solid lubricant, or a cleavage solid inorganic lubricant.

Among the solid lubricants mentioned previously, more preferred as the solid lubricant according to the present invention are layered clay minerals. The first reason why the layered clay minerals are preferred as a solid lubricant for the lubricating coating agent according to the present invention is because of superior lubricity, and further superior acid resistance as compared with crystalline inorganic salts. The lubricating coating agent according to the present invention is acidic, and a solid lubricant that is insoluble or poorly soluble in acid is thus more preferred.

The previously mentioned layered clay minerals can include a smectite group of natural products and synthetic products, a vermiculite group of natural products and synthetic products, a mica group of natural products and synthetic products, a brittle mica group of natural products and synthetic products, a pyrophyllite group of natural products and synthetic products, and a kaolinite group of natural products and synthetic products. These layered clay minerals may be each used alone, or more than one thereof may be used in combination.

Furthermore, the layered clay mineral will be described in more detail. Clay minerals are main-constituent minerals constituting clay, layered silicate minerals (phyllosilicate minerals), calcite, dolomite, feldspars, quartz, boiling stones (zeolite), and others, minerals that have chain-like structures (such as attapulgite, sepiolite), minerals that have no clearly crystal structure (allophane), and the like are referred to as clay minerals, and in general, layered silicate minerals among the clay minerals are referred to as layered clay minerals.

The layered clay mineral forms a crystal structure that has two-dimensional layers of positive and negative ions stacked parallel and bonded, and this layered structure has therein two structural units: one unit of a tetrahedral layer composed of $Si^{4+}$ and $O^{2-}$ surrounding the $Si^{4+}$; the other of an octahedral layer composed of $Al^{3+}$ (or $Mg^{2+}$, $Fe^{2+}$, or the like) and $(OH)^-$ surrounding the $Al^{3+}$.

In the tetrahedral layer, O located at four vertexes of the tetrahedron and Si located in the center form tetrahedrons of Si—O, which are linked to each other at the three vertexes to spread two-dimensionally, thereby forming a layer lattice that has a composition of $Si_4O_{10}$. The $Si^{4+}$ is often substituted with $Al^{3+}$.

In the octahedral layer, octahedrons formed by (OH) or O located at six vertexes of the octahedron and Al, Mg, Fe, or the like located in the center are linked at each vertex to spread two-dimensionally, thereby forming a layer lattice that has a composition of $Al_2(OH)_6$, $Mg_3(OH)_6$, or the like.

The octahedral layers include: a 3-octahedral type that has lattice points all occupied with a divalent cation (such as $Mg^{2+}$) at the lattice point of cation surrounded by six anions; and a 2-octahedral type that has ⅔ lattice points occupied with a trivalent cation (such as $Al^{3+}$) at the lattice point of cation, and ⅓ lattice points remaining vacant.

There are two types of combinations of tetrahedral layers and octahedral layers: one of the combinations is a 2:1 type structure that has, as a unit, a linkage of two tetrahedral layers and one octahedral layer sandwiched therebetween; and the other is a 1:1 type structure that has, as a unit, a linkage of one tetrahedral layer and one octahedral layer. The smectite group, vermiculite group, mica group, and pyrophyllite group mentioned previously refer to layered clay minerals that have the 2:1 type structure, whereas the kaolinite group refers to layered clay minerals that have the 1:1 type structure.

With regard to the relationship between the hydrophilicity of the layered clay mineral and the crystal structure, for example, as for kaolin, the layered clay mineral has the 1:1 crystal structure, which is believed to exhibit hydrophilicity due to the orientation of octahedrons with hydrophilic groups (such as OH) at the surface. On the other hand, in the case of the 2:1 crystal structure, there is believed to be a strong tendency to be lower in hydrophilicity than the 1:1 structure, because of the orientation of tetrahedrons having hydrophobic groups (SiO) at the surface.

To explain layered clay minerals that belong to the respective groups in more detail, the smectite group includes montmorillonite, beidellite, nontronite, saponite, iron saponite, hectorite, sauconite, and stevensite, the vermiculite group includes di.vermiculite and tri.vermiculite, the mica group includes muscovite, palagonite, illite, phlogopite, biotite, lepidolite, and lepidolite, the brittle mica group includes margarite and clintonite, the pyrophyllite group includes pyrophyllite and talc, and the kaolinite group includes kaolinite, dickite, nacrite, halloysite, chrysotile, lizardite, and antigorite. Among these minerals, particularly preferred is at least one selected from the two layered clay minerals that belong to the pyrophyllite group mentioned above. The reason is because the layered clay minerals that belong to the pyrophyllite group are low in Mohs hardness and excellent in lipophilicity. It is to be noted that the Mohs hardness of the layered clay mineral and the relationship between lipophilicity and lubricity will be described in detail later.

In the lubricating coating agent according to the present invention, it is also possible to use, as the lubricating component, the previously mentioned lipophilic lubricating component and the previously mentioned solid lubricant each alone, but these components are used in combination as a preferred form of lubricating component. The use of the solid lubricant and the lipophilic lubricating component in combination improves galling resistance and slidability, thereby making it possible to achieve higher lubricity.

The second reason why the layered clay minerals are preferred as a solid lubricant according to the present invention is because the layered clay minerals which have a layered structure can include the previously mentioned lipophilic lubricating component between particles of and/or between layers of the minerals. More specifically, the reason is because the inclusion of the previously mentioned lipophilic lubricating component between particles and/or between layers corresponding to cleavage faces of the previously mentioned layered clay mineral with cleavage can further enhance the cleavage of the layered clay mineral, and further cause a solid lubricant to take as a role of carrier particles for causing the lipophilic lubricating component to follow in a more efficient manner to an area expansion of the worked surface during working. To explain in more detail, the layered clay mineral refers to particles of two-dimensional layered crystals stacked parallel and bonded. According to the present invention, the spaces between surfaces of the layered crystals are defined as interlayer spaces. Furthermore, when the previously mentioned layered crystals stacked parallel and bonded are regarded as primary particles, multiple primary particles may further aggregate (agglomerate) into larger secondary particles (the layered clay mineral that forms the secondary particles is referred to as an "aggregated layered clay mineral"), and in this case, the spaces between the particles are defined as inter-particle spaces. Both the interlayer spaces and the inter-particle spaces are loosely bonded in a layered form, which serve as cleavage faces that are capable of including a lipophilic lubricating component according to the present invention. The inclusion of the lipophilic lubricating component between the particles of and/or between the layers of the layered clay mineral with cleavage allows the layered clay mineral and the lipophilic lubricating component to follow at the same time, that is, to take a role as carrier particles, even in working which is high in working load and high in the area expansion factor of the worked surface, such as cold plastic working, thereby imparting slidability at the same time as the prevention of galling, and thus allowing for improved lubricity. The previous techniques have never achieved any acidic lubricating coating agent that can cause the layered clay mineral in the lubricating coating agent to take a role as carrier particles as just described, and further form a chemical conversion coating at the same time as a lubricating coating. It is to be noted that the "inclusion" herein means conditions that the lipophilic lubricating component is trapped between particles of and/or between layers of the layered clay mineral. More specifically, in the carrier particles according to the present invention, when the layered clay mineral is not cleaved, the lipophilic lubricating component is held between the particles of and/or between the layers of the layered clay mineral, and this condition is referred to as an "inclusion" condition according to the present invention. On the other hand, when the layered clay mineral is cleaved during working, the lipophilic lubricating component included between the particles of and/or between the layers of the layered clay mineral exudes to the worked surface, and the exudation of the lipophilic lubricating component follows along with the layered clay mineral so as to wet the worked surface.

The concentration of the lubricating component in the lubricating coating, that is, the total concentration of the previously mentioned solid lubricant, lipophilic lubricating component, and carrier particles including the lipophilic lubricating component between the particles of and/or between the layers of the layered clay mineral is 5 mass % or more, more preferably 10 mass % or more in mass ratio to the mass of the total solid content (coating component) in the lubricating coating agent. The concentration of the lubricating component below 5 mass % may lead to failure to achieve expected lubricity. On the other hand, the upper limit of the concentration of the lubricating component is not particularly limited, but for example, 96 mass % or less.

For the achievement of excellent lubricity, it is important for the lipophilic lubricating component to be included between the particles of and/or between the layers of the layered clay mineral in a more efficient manner. Parameters regarding the efficiency of the inclusion will be described. First, the parameters of the lipophilic lubricating component include a solubility parameter (SP value, unit $(cal/cm^3)^{1/2}$). The solubility parameter refers to a parameter for solubility or compatibility in a two-component system. The solubility or compatibility is supposed to be better as the solubility parameters of the components are closer in value to each other. Various methods are disclosed for the measurement method. For example, methods such as a method of evaluation from solubility in a solvent with a known SP value, a Fedors method based on theoretical calculation, and a turbidimetric titration method are typical measurement methods. The turbidimetric titration method devised by K. WSuh, et., al. was applied to the method for measuring the SP value according to the present invention (J. Appl. Polym. Sci., 12, 2359 (1968)). In accordance with the turbidimetric titration method, the SP value of the lipophilic lubricating component can be evaluated by dissolving the lipophilic lubricating component in a good solvent with a known SP value, and carry out turbidimetric titration with a poor solvent that is higher in SP value than the good solvent and a poor solvent that is lower in SP value than the good solvent. The SP value of water is approximately 23, and as the SP value of a target component is lower than that of water, the lipophilicity is higher.

The lipophilic lubricating component for use in the present invention preferably has an SP value of 10 or less, and further preferably 9 or less. When the SP value of the lipophilic lubricating component exceeds 10, the amount of the lipophilic lubricating component included between the layers of the layered clay mineral may be decreased due to decreased lipophilicity, thereby decreasing the lubricity. In addition, due to the decreased hydrophobicity of the lubricating component, the barrier properties against corrosive factors such as water and chlorine may be decreased, thereby decreasing the corrosion resistance. The lower limit of the SP value of the lipophilic lubricating component is not to be considered particularly specified, but for example, 7 or more.

In the case of using two or more types in mixture in the lipophilic lubricating component (for example, the oil and the extreme-pressure agent), as long as the difference is 1.5 or less between the respective SP values, excellent compatibility can achieve higher lubricity.

Furthermore, for the inclusion of the lipophilic lubricating component between the particles of and/or between the layers of the layered clay mineral in a more efficient manner, the layered clay mineral itself has preferably lipophilic properties between layers of and on the surface of the layered clay mineral. Parameters therefor include a water contact angle. The water contact angle at the surface of the layered clay mineral alone may be preferably 40° or more, further preferably 60° or more. The upper limit of the water contact angle at the layered clay mineral is not to be considered particularly specified, but for example, 150° or less. The combination of the lipophilic lubricating component that has an SP value of 10 or less with the layered clay mineral that is 40° or more in water contact angle can achieve the inclusion of the lipophilic lubricating component between the particles and/or between the layers in a more efficient manner, because of high mutual lipophilicity and affinity.

The inclusion amount of the lipophilic lubricating component is preferably 5 mass % or more, and further preferably 8 mass % or more in mass ratio to the total mass of the carrier particles. When the inclusion amount falls below 5 mass %, the lubricity during working may be decreased, thereby causing galling. The upper limit of the inclusion amount of the lipophilic lubricating component is not to be considered particularly limited, but for example, 50 mass % or lower.

In addition, a layered clay mineral with an organic substance supported between layers of the layered clay mineral by the method described in the International Publication WO 2012/086564 A may be used as the layered clay mineral mentioned previously. Examples of the organic substance can include at least one cationic organic compound (organic group+cationic group) selected from organic ammonium compounds, organic phosphonium compounds, and organic sulfonium compounds. In this regard, the organic group of the organic compound is not particularly limited, but preferred are straight-chain, branched-chain, and cyclic (having a cyclic group) saturated hydrocarbon or unsaturated hydrocarbon groups having 1 to 30 carbon atoms. In addition, the hydrogen atoms bonded to the carbon atoms constituting the carbon chains or the carbon rings may be substituted with other substituent groups, some of the carbon atoms constituting the carbon chains or the carbon rings may be substituted with other atoms (such as 0 and S, for example), and furthermore, other linkages (for example, ester linkages, ether linkages) may be included between C—C chains. Preferred is an organic ammonium compound composed of: an aliphatic hydrocarbon group (preferably having 1 to 30 carbon atoms) which is advantageous for friction reducing ability; and an ammonium group which is advantageous for interlayer fixing ability. In this regard, chlorides, bromides, iodides, nitrates, fluorides, hydroxides, and the like are preferred as organic salts for use in the interlayer introduction of the organic compound. Particularly preferred organic salts are quaternary ammonium chlorides from which by-product salts are easily removed by water rinsing (such as capryl trimethyl ammonium chlorides, lauryl trimethyl ammonium chlorides, stearyl trimethyl ammonium chlorides, dicapryl dimethyl ammonium chlorides, dilauryl dimethyl ammonium chlorides, and distearyl dimethyl ammonium chlorides). Supporting the foregoing organic substances between the layers of the layered clay mineral increases the interlayer distance, and further hydrophobizes between layers of and the surface of the layered clay mineral, thus advantageously allowing the lipophilic lubricating component to be included more.

The layered clay mineral mentioned previously is preferably 0.5 to 30 μm, more preferably 1 to 20 μm, and further preferably 1 to 10 μm in average particle size. The average particle size of 30 μm or less makes the lipophilic lubricating component likely to be included between the layer, thus improving the lubricity and the corrosion resistance. In addition, as the average particle size is reduced to 30 μm or less, 20 μm or less, and 10 μm or less, the lubricity is further improved. Even when the average particle size is less than 0.5 μm, the lubricity and the corrosion resistance are favorable, and the average particle size is selected from the perspective of cost (manufacturing cost)—effectiveness (lubricity and corrosion resistance).

Furthermore, the aspect ratio in a cross section of the layered clay mineral preferably falls within the range of 3 to 150, more preferably 5 to 100, further preferably 5 to 30. The aspect ratio in excess of 150 reduces the inclusion amount of the lipophilic lubricating amount, thereby possibly decreasing the lubricity and the corrosion resistance in some cases. In addition, the lubricity is further improved as the aspect ratio is reduced to 150 or less, 100 or less, and 30 or less. In contrast, when the aspect ratio falls below 3, the inclusion amount of the lipophilic lubricating component has no problem, but due to the layered clay mineral particles increased in thickness, the following performance of the lubricating coating may be decreased, thereby deteriorating the lubricity.

The average particle size of the layered clay mineral can be measured by a laser diffraction method (volumetric basis). The average particle size of the layered clay mineral according to the present invention is intended for primary particles, and in order to keep as much as possible from being affected by secondary particles as aggregates of the primary particles, particle sizes are measured after enhancing redispersion (breaking secondary particles of the primary particles aggregated, thereby separating the secondary particles again into primary particles) with ultrasonic for approximately 3 to 5 minutes in advance. Thus, the average particle size for substantially primary particles can be measured by eliminating as much as possible the influence of secondary particles of the primary particles aggregated. Therefore, the average particle size of the layered clay mineral according to the present invention refers to an average value on a volumetric basis for the particle sizes of the primary particles of the layered clay mineral.

In addition, the aspect ratio according to the present invention is supposed to be defined as an aspect ratio in a cross section of the layered clay mineral, and obtained from the following formula. More specifically, the layered clay mineral for use in the present invention have plate-like or scale-like particles of two-dimensionally layered crystals stacked parallel and bonded as mentioned previously, and the proportion of the length of a planar part (that is, a crystal face parallel to a cleavage face) to the thickness of the particle (the length in a direction perpendicular to the cleavage face) corresponds to the aspect ratio in a cross section of the layered clay mineral. The thickness of the layered clay mineral particle and the length of the planar part can be measured at a magnification on the order of 3000 times with a scanning electron microscope (SEM). It is to be noted that the thickness of the layered clay mineral particle refers to a thickness that can be observed in the case of observation at approximately 3000-fold magnification with a SEM, but is not necessarily considered to mean the thickness of a unit lattice.

aspect ratio=length of planar part of particle/thickness of particle

In the method for manufacturing the carrier particles, parameters for efficiently including the lipophilic lubricating component between particles of and/or between layers of the layered clay mineral are three of: (1) the lipophilicity of the layered clay mineral and the SP value of the lipophilic lubricating component; (2) inclusion method; and (3) the average particle size and aspect ratio of the layered clay mineral. For the lipophilicity (water contact angle), average particle size, and aspect ratio of the layered clay mineral, and the SP value of the lipophilic lubricating component, preferred ranges are adapted as mentioned previously.

Next, an example of inclusion method will be described in a method for manufacturing the carrier particles. Examples of the inclusion method include in the case of an oil and an extreme-pressure agent that are liquid at room temperature, an method of adding the oil and the extreme-pressure agent in predetermined amounts to a powder of the layered clay mineral, and causing the mineral to include therein the oil and the agent while stirring. In addition, in the case of desiring the inclusion achieved in a short period of time and desiring the increased inclusion amount, it is preferable to apply a so-called reduced-pressure impregnation method of, not simply the addition/stirring, but mixing the layered clay mineral, the oil, and the extreme-pressure agent in a decompression tank, and then returning the pressure to the atmospheric pressure, a method of inclusion with the oil warmed and thus reduced in viscosity, or the like. On the other hand, methods for the inclusion of a soap or a wax that is solid at room temperature include a method of turning the soap or the wax into a liquid at a temperature equal to or higher than the melting point thereof, and then mixing the liquid with the layered clay mineral, thereby causing the layers to include the liquid therebetween, and a method of applying the lubricant to a metal material surface, and then putting the material in an oven kept at a temperature equal to or higher than the melting point, thereby causing the layers to include the soap or the wax therebetween during the drying. In each case, mixing with the lipophilic lubricating component in an amount equal to or larger than the amount includable between the layers can interpose the lipophilic lubricating component not only between the layers, but also between the particles.

As just described, the lipophilicity of the layered clay mineral and the SP value of the lipophilic lubricating component as well as the average particle size and aspect ratio of the layered clay mineral are adapted to fall within the specific ranges, thereby making it possible to ensure, in a more reliable manner, that the inclusion amount of the lipophilic lubricating component into the layered clay mineral is 5 mass % or more. Furthermore, the reduced-pressure impregnation method, the method of mixing, with the layered clay mineral, a soap or a wax turned into a liquid at a temperature equal to or higher than the melting point thereof, thereby causing the particles and the layers to include the soap or the wax therebetween, or a method of applying the lubricant to a metal material surface, and then putting the material in an oven kept at a temperature equal to or higher than the melting point, thereby causing the particles and layers to include the soap or the wax therebetween during the drying is used, thereby making it possible to further increase the inclusion amount of the lipophilic lubricating component.

The layered clay mineral for use in the solid lubricant according to the present invention preferably has Mohs hardness of 2 or less from the perspective of lubricity. Further preferred Mohs hardness is 1. The reason is because while the solid lubricant is broken to follow in the direction of area expansion at the surface worked in plastic working or press working, there is a tendency to achieve a lower friction coefficient and better carrier property for the lipophilic lubricating component as the layered clay mineral is lower in Mohs hardness, and as a result, better lubricity is achieved. The "carrier property" herein means that as a result of decreasing the friction coefficient of the layered clay mineral, the layered clay mineral is made more likely to follow in the direction of area expansion, and the lipophilic lubricating component is thus made likely to follow, along with the layered clay mineral, in the direction of area expansion at the worked surface. It is to be noted that the Mohs hardness can be measured with a Mohs scale. More specifically, 10 types (10-level Mohs hardness from 1 to 10:1 for the softest and 10 for the hardest) of minerals that differ in hardness are adopted as reference materials, thereby evaluating whether the surface of the target material is scratched by a reference material or not. When the surface is not scratched, the reference material with higher hardness is used and evaluated until being scratched. When the surface is scratched, it is confirmed that the surface of the reference material is reversely scratched by the target material, thereby determining the Mohs hardness of the substance. This is because the materials can scratch each other as long as the materials have the same hardness.

As mentioned previously, most preferred as the layered clay mineral for use in the lubricating coating agent according to the present invention are pyrophyllite that belongs to the pyrophyllite group, and talc. The reason therefor is because these layered clay minerals have a water contact angle of 110°, and thus high lipophilicity, and with Mohs hardness of 1, belong to the softest layered clay minerals.

Further, as the lubricating component in the lubricating coating agent according to the present invention, from the perspective of enhancing the lubricity, the case (1) of using only the lipophilic lubricating component mentioned previously, the case (2) of using only the solid lubricant (the crystalline inorganic salt and/or the layered clay mineral) mentioned previously, the case (3) of using the solid lubricant and the lipophilic lubricating component in combination, the case (4) of using only the carrier particles mentioned previously, the case (5) of using the carrier particles and the lipophilic lubricating component in combination, the case (6) of using the carrier particles and the solid lubricant in combination, and the case (7) of using the carrier particles, the lipophilic lubricating component, and the solid lubricant in combination are preferred, the cases (3) to (7) are more preferred, and the cases (4) to (7) of at least including the carrier particles as the lubricating component are particularly preferred. It is to be noted that the lipophilic lubricating component is not included between the particles of and/or between the layers of the layered clay mineral in the case (3).

The lubricating coating agent for a metal material according to the present invention can be, for the achievement of higher lubricity, further blended with at least one selected from the group consisting of a water-soluble inorganic salt, a water-soluble organic salt, and a water-based resin, as a binder component for a lubricating coating. Blending the lubricating coating agent according to the present invention with these components can attach the lubricating component more strongly to metal material surfaces, thus achieving higher lubricity.

Specifically, the water-soluble inorganic salt has at least one selected from the group consisting of sulfates, silicates, borates, molybdates, vanadates, and tungstates. The water-soluble organic salt has at least one selected from the group consisting of malates, succinates, citrates, and tartrates. The cations of these salts have at least one selected from the group consisting of a sodium ion, a potassium ion, a lithium ion, an ammonium ion, amines (such as ethylamine), and alkanolamines (such as monoethanolamine and diethanolamine).

As the water-based resin, that is, water-soluble or water-dispersible polymer resin, at least one can be selected from polymer resins of 1,000 to 1,000,000 in weight average molecular weight. In addition, the water-dispersible polymer resin is preferably 0.5 to 50 μm in average particle size (volumetric basis). The type of the polymer resin is not particularly limited as long as the polymer resin has coating formability, and stable solubility or dispersibility, but for example, polymer resins can be used, such as acrylic resins, urethane resins, epoxy resins, phenolic resins, hydroxyethyl cellulose, carboxymethyl cellulose, and polyvinyl alcohol. It is to be noted that the weight average molecular weight of the polymer resin can be measured by a gel permeation chromatography method (GPC method). In addition, the average particle size of the polymer resin can be measured in the same way as the average particle size of the layered clay mineral mentioned previously.

In the lubricating coating agent according to the present invention, any of non-ionic surfactants, anionic surfactants, amphoteric surfactants, and cationic surfactants can be used as a surfactant that disperses, in water, the solid lubricant according to the present invention and the oil and the extreme-pressure agent. The non-ionic surfactants include, but not particularly limited thereto, for example, polyoxyethylene alkyl esters obtained from polyoxyethylene alkyl ether, polyoxyalkylene (ethylene and/or propylene) alkyl phenyl ether, or polyethylene glycol (or ethylene oxide) and a higher fatty acid (for example, 12 to 18 carbon atoms); and polyoxyethylene sorbitan alkyl esters composed of obtained from sorbitan, polyethylene glycol, and a higher fatty acid (for example, 12 to 18 carbon atoms). The anionic surfactants include, but not particularly limited thereto, for example, fatty acid salts, sulfates, sulfonates, phosphates, and dithiophosphates. The amphoteric surfactants include, but not particularly limited thereto, for example, amino acid-type and betaine-type carboxylates, sulfates, sulfonates, and phosphates. The cationic surfactants include, but not particularly limited thereto, for example, aliphatic amine salts and quaternary ammonium salts. These surfactants can be each used alone, or two or more of the surfactants can be used in combination.

The concentration of the surfactant is preferably 0.5 to 20 mass % in mass ratio to the mass of the total solid content (coating component) in the lubricating coating agent. When the proportion of the surfactant exceeds 20 mass %, the dispersibility of the solid lubricant is improved, while the lubricating coating may become fragile, thereby decreasing the lubricity. On the other hand, when the proportion falls below 0.5 mass %, the dispersibility of the solid lubricant is worsened, thereby making it impossible to form any uniform lubricating coating.

A surface-treated metal material according to the present invention is characterized in that a chemical conversion coating for a lower layer is formed to achieve a coating amount of 0.1 $g/m^2$ or more, more preferably 0.3 $g/m^2$ or more, whereas a lubricating coating for an upper layer is formed to achieve a coating amount of 0.5 $g/m^2$ or more, more preferably 3 $g/m^2$ or more. The set coating amount may be determined appropriately depending on the working level required. However, when the coating amounts fall below the lower limits mentioned previously, the chemical conversion coating or the lubricating coating may fail to fully coat a metal material surface depending on the roughness of the surface, and attention is thus required in terms of lubricity and corrosion resistance. In addition, the upper limits are not particularly specified, but the lower chemical conversion coating has an upper limit of 3 $g/m^2$, whereas the upper lubricating coating has an upper limit of 40 $g/m^2$. Even when the coatings are formed in excess of the upper limits, lubricity improved enough to meet the formation can be no longer expected, which is not economical, and problems may be even caused, such as defectively even application, defective adhesion, and the production of indentation by the remaining coating.

The coating amount of the lower chemical conversion coating can be adjusted with the treatment temperature and the treatment time. The coating amount tends to be increased as the treatment temperature is higher, and increased as the treatment time is longer. Therefore, the appropriate adjustment of the two parameters can set conditions for achieving a target coating formation amount. Alternatively, the coating amount of the lower chemical conversion coating may be adjusted by adjusting the concentration of the chemical conversion component, and the condition for the achievement of the target coating formation amount may be set by appropriately adjusting the concentration of the chemical conversion component.

In addition, the upper coating amount can be adjusted with the concentration of the total solid content including the lubricating component in the lubricating coating agent. More specifically, when the total mass (including water) of the lubricating coating agent is regarded as 100 mass %, the coating amount of 0.5 g/m$^2$ or more can be obtained as long as the previously mentioned total solid content concentration is 3 mass % or more. The concentration lower than the foregoing concentration reduces the dried coating amount, thereby leading to failure to achieve expected lubricity in some cases. On the other hand, the upper limit of the concentration of the total solid content is not to be considered particularly limited, but for example, 70 mass % or lower, more preferably 50 mass % or lower.

Further, the concentration of the total solid content (coating component) with respect to the total mass (also including water) of the lubricating coating agent can be measured by the following method. More specifically, the lubricating coating agent is collected in a defined amount into a container made of Teflon (registered trademark), and the collection amount is weighed accurately. Thereafter, volatile components such as water are evaporated in an oven at 110° C. for 2 hours, and the amount of residue (non-volatile component) is weighed accurately. The total solid content concentration is calculated from the following formula with the respective weighing values. It is to be noted that the weighing value after drying in the following formula corresponds to "the mass of the total solid content (coating component)" in calculating the concentration of the solid lubricant in the water-based lubricating coating agent.

total solid content concentration(mass %)=[(weighing value after drying)/(weighing value before drying)]×100

A method for forming a lubricating coating for a metal material according to the present invention and a method for manufacturing a surface-treated metal material according to the present invention are characterized by including a contact step of bringing a metal material into contact with the lubricating coating agent for metal materials according to the present invention. Specifically, examples thereof include an immersion method, a flow coating method, a spray method, brush coating, and a cathode electrolysis method. The temperature and the time are important factors for adjusting the coating amount of the chemical conversion coating, the immersion method or the spray method is a more preferred method, because the method can easily control the treatment temperature and the treatment time. Specifically, the treatment temperature and the treatment time may be appropriately adjusted respectively within the ranges of 30 to 70° C. and 15 to 300 seconds, so as to achieve a predetermined coating amount of chemical conversion coating. In addition, for the drying, the agent may be left at room temperature, but preferably at 60 to 150° C. for 1 to 30 minutes. In order to further enhance drying characteristics, it is preferable to warm the metal material to 60 to 100° C., and bring the warmed metal material into contact with the lubricating coating agent. It is to be noted that the metal material may be brought into contact with the lubricating coating agent warmed to 50° C. to 90° C. Thus, the drying characteristics are improved significantly, thereby making drying possible at room temperature in some cases, and thus making it possible to reduce the thermal energy loss.

In addition, in the case of the cathode electrolysis method, an electrolytic treatment may be carried out with the use of a test specimen as a cathode and of an insoluble anode such as lead or stainless steel for an anode. In this case, no sludge is generated because chemical conversion coatings can be formed without any etching reaction, and chemical conversion coatings can be formed also in the case of metal materials which are less likely to be etched, such as stainless steel. The electrolysis conditions are not particularly limited, but may be adjusted appropriately within the ranges of 5 to 40 A/dm$^2$ and electrolysis time: 2 to 60 seconds, depending on the required coating amount of chemical conversion coating.

Furthermore, in order to improve the adhesion of the lubricating coating, it is preferable to clean up the metal material by at least one approach selected from the group consisting of shot blasting, sandblasting, alkaline degreasing, and acid cleaning (cleanup step) before the lubricating coating treatment (contact step). In this regard, the cleanup is intended to remove oxide scale grown by annealing or the like, and various types of contamination (e.g., oil). In particular, in recent years, reduced wastewater treatment burdens have been desired due to environmental concerns. In this case, the absence of wastewater can be achieved just by cleaning up the metal material surface by shot blasting, and then carrying out the contact step with the use of the lubricating coating agent according to the present invention.

EXAMPLES

Effects of the present invention will be verified with reference to examples and comparative examples. Here are details of the respective components for manufacturing lubricating coating agents for metal material for use in the examples and comparative examples.

[Chemical Conversion Component]

A-1 phosphoric acid compound: primary sodium phosphate

A-2 phosphoric acid compound: primary zinc phosphate

A-3 oxalic acid compound: oxalic acid

A-4 ammonium molybdate

A-5 zirconium compound: fluorozirconic acid

A-6 titanium compound: fluorotitanic acid

[Solid Lubricant]

Here are details of layered clay minerals (before the inclusion of the lipophilic lubricating component) and crystalline inorganic salts used for tests. The average particle size of the solid lubricant was measured by a laser diffraction method on a volumetric basis under the following conditions after the redispersion of the solid lubricant into primary particles with ultrasonic in water for 3 minutes in advance.

name of measurement machine: LA-920 from Horiba, Ltd.

data loading frequency: 10 times calculation frequency: 30 times ultrasound intensity: 7 ultrasound time: 3 minutes dispersion medium circulation speed: 3

In addition, the aspect ratio was measured only in the case of the layered clay mineral. The aspect ratio was calculated from the thickness of the particle (the length in a direction perpendicular to a cleavage face) and the length of the planar part (that is, the crystal face parallel to the cleavage face) by observation of the layered clay mineral at a magnification of 3000 times with a scanning electron microscope. The layered clay mineral was subjected to an organic treatment in accordance with the method described in International Publication WO 2012/086564 A. The water contact angle was measured with a bed of layered clay mineral powder between two copper plates (50×50 mm), which was pressed at a tightening force of 100 kgf into the form of a coating. An automatic contact angle meter DM-501 from Kyowa Interface Science Co., Ltd. was used for the measurement.

<By Water Contact Angle>

B-1 kaolinite: average particle size 3 μm, water contact angle 20°, Mohs hardness 2 aspect ratio: 20

B-2 organic treated kaolinite: average particle size 3 μm, water contact angle 40°, Mohs hardness 2 aspect ratio: 20 distearyl dimethyl ammonium chloride treated with an organic matter corresponding to 0.2 molar quantity with respect to the cation exchange capacity (CEC value)

B-3 organic treated kaolinite: average particle size 3 μm, water contact angle 60°, Mohs hardness 2 aspect ratio: 20 distearyl dimethyl ammonium chloride treated with an organic matter corresponding to 0.4 molar quantity with respect to the cation exchange capacity (CEC value)

B-4 organic treated kaolinite: average particle size 3 μm, water contact angle 110°, Mohs hardness 2 aspect ratio: 20 distearyl dimethyl ammonium chloride treated with an organic matter corresponding to 1.0 molar quantity with respect to the cation exchange capacity (CEC value)

<By Mohs Hardness>

B-5 talc: average particle size 3 μm, water contact angle 110°, Mohs hardness 1 aspect ratio: 20

B-6 synthetic mica: average particle size 3 μm, water contact angle 110°, Mohs hardness 3 aspect ratio: 20

<By Average Particle Size>

B-7 talc: average particle size 0.5 μm, water contact angle 110°, Mohs hardness 1 aspect ratio: 20

B-8 talc: average particle size 10 μm, water contact angle 110°, Mohs hardness 1 aspect ratio: 20

B-9 talc: average particle size 20 μm, water contact angle 110°, Mohs hardness 1 aspect ratio: 20

B-10 talc: average particle size 30 μm, water contact angle 110°, Mohs hardness 1 aspect ratio: 20

B-11 talc: average particle size 40 μm, water contact angle 110°, Mohs hardness 1 aspect ratio: 20

<By Aspect Ratio>

B-12 talc: average particle size 10 μm, water contact angle 110°, Mohs hardness 1 aspect ratio: 2.5

B-13 talc: average particle size 10 μm, water contact angle 110°, Mohs hardness 1 aspect ratio: 3

B-14 talc: average particle size 10 μm, water contact angle 110°, Mohs hardness 1 aspect ratio: 5

B-15 talc: average particle size 10 μm, water contact angle 110°, Mohs hardness 1 aspect ratio: 30

B-16 talc: average particle size 10 μm, water contact angle 110°, Mohs hardness 1 aspect ratio: 100

B-17 talc: average particle size 10 μm, water contact angle 110°, Mohs hardness 1 aspect ratio: 150

B-18 talc: average particle size 10 μm, water contact angle 110°, Mohs hardness 1 aspect ratio: 170

<Crystalline Inorganic Salt>

B-19 calcium sulfate: average particle size 3 μm, water contact angle 30°, Mohs hardness 2

B-20 lithium phosphate: average particle size 3 μm, water contact angle 40°, Mohs hardness 4

<Black Base>

B-21 molybdenum disulfide: average particle size 3 μm, water contact angle 120°, Mohs hardness 1 aspect ratio: 20

[Lipophilic Lubricating Component]

Here are lipophilic lubricating components. It is to be noted that the previously mentioned turbidimetric titration method was applied to the method for measuring the solubility parameter (SP value).

<Oil>

C-1 plant oil: palm oil, SP value 8.5

C-2 plant oil: castor oil, SP value 9.0

C-3 plant oil: polyoxyethylene castor oil (product with 0.5 mol of ethylene oxide added), SP value 10.0

C-4 plant oil: polyoxyethylene castor oil (product with 1 mol of ethylene oxide added), SP value 11.6

C-5 mineral oil: naphthenic mineral oil, SP value 8.3

C-6 synthetic oil: trimethylolpropane trioleate, SP value 8.7

<Extreme-Pressure Agent>

C-7 tricresyl phosphate: SP value 8.9

<Soap>

C-8 zinc stearate: melting point 120° C., SP value 8.7

<Wax>

C-9 polyethylene wax: melting point 110° C., SP value 8.1

<Mixture of Oil and Extreme-Pressure Agent>

C-10 (C-1):(C-7)=1:0.02 (mass ratio)

C-11 (C-1):(C-7)=1:0.03 (mass ratio)

C-12 (C-1):(C-7)=1:0.1 (mass ratio)

C-13 (C-1):(C-7)=1:1 (mass ratio)

C-14 (C-1):(C-7)=1:1.1 (mass ratio)

Here are binder components used for tests.

<Binder Component>

D-1 sodium tungstate

D-2 potassium tetraborate

D-3 sodium tartrate

D-4 water-based acrylic resin: copolymerization product of methylmethacrylate and n-butylacrylate, subjected to emulsion polymerization with polyoxyethylene alkyl phenyl ether (molecular weight: 150000 or more), average particle size 0.5 μm, solid content concentration 40 mass %

D-5 water-based urethane resin: molecular weight 100000, average particle size 1.0 μm, solid content concentration 40 mass %

Here is a surfactant used for tests.

<Surfactant>

E-1 polyoxyethylene sorbitol tetraoleate (60 mol ethylene oxide added)

[Method for Inclusion of Lipophilic Lubricant Between Particles and/or Between Layers of Layered Clay Mineral]

As for the oil and extreme-pressure agent that are liquid at room temperature, the oil and the extreme-pressure agent were added to the layered clay mineral in proportions equal to or larger than an includable amount (1:1 in mass ratio), and mixed with the use of a mortar until being homogeneous in whole, thereby resulting in the lubricating component included between particles and/or between layers. Thereafter, the excess oil and extreme-pressure adhering to the surface of the layered clay mineral were removed by immersion in boiling water for 10 minutes, and the layered clay mineral was left to dry at room temperature for 24 hours. Alternatively, in the case of zinc stearate and wax which are poorly-soluble and solid at room temperature, the lubricating component turned into a liquid at a temperature equal to or higher than the melting points was added to the layered clay mineral (1:1 in mass ratio), and mixed therewith in a mortar until becoming fully homogeneous, thereby resulting in the lubricating component included between particles and/or between layers. Thereafter, the wax (or zinc stearate) adhering to particle surfaces was removed by immersion for 10 minutes in an oil bath warmed to a temperature equal to the melting point of the wax (or zinc stearate) or higher, thereafter, the oil on the particle surfaces was removed by immersion in boiling water for 10 minutes, and thereafter, the layered clay mineral was left to dry at room temperature for 24 hours.

[Method for Measuring Inclusion Amount of Lipophilic Lubricating Component]

The inclusion amount of the lipophilic lubricating component was measured with the use of a total organic carbon meter (TOC-5000/SSM-5000A from Shimadzu Corporation) equipped with a solid sample burning system. The measuring method will be mentioned in detail below. First, a lipophilic lubricating component alone (lipophilic lubricating component itself) to be included was used and burned completely at a furnace temperature of 700° C., thereby creating a calibration curve of carbon intensity-lubricating component amount. Next, measured is the carbon intensity in carrier particles with the lipophilic lubricating component included between particles of and/or between layers of the layered clay mineral by the previously mentioned method under the same condition, and the obtained value is converted to the lubricating component amount.

inclusion amount (%)=(mass of lipophilic lubricating component/total mass of carrier particle)×100

[Method for Measuring Coating Amount of Lubricating Coating]

<Upper Layer>

The coating amount of the upper lubricating coating was calculated from the mass decrease of the test piece between before and after removing the lubricating coating through immersion of the test piece subjected to the lubrication treatment in boiling water for 1 hour.

coating amount ($g/m^2$)=(test piece mass before removing−test piece mass after removing)/surface area of test piece <Lower Layer>

The coating amount obtained when the lower chemical conversion coating was a phosphate or an oxalate was calculated from the mass decrease of the test piece between before and after removing the chemical conversion coating further through immersion of the test piece with the upper layer removed therefrom in a 5% chromic acid aqueous solution under the condition of room temperature for 30 minutes.

coating amount ($g/m^2$)=(test piece mass before removing−test piece mass after removing)/surface area of test piece In the case of a zirconium compound or a titanium compound, each metal coating amount was measured with an X-ray fluorescence analytical instrument (model: ZSX PrimusII from Rigaku Corporation), and from the value, the coating amount was calculated through the conversion to an oxide.

[Treatment Method]

<Step A>

(1) degreasing: a test piece (metal material) was immersed for 10 minutes in a commercially available degreasing agent (registered trademark: FINECLEANER E6400 from Nihon Parkerizing Co., Ltd., concentration: 20 g/L) warmed to 60° C.

(2) water rinsing: the degreased test piece was immersed for 10 seconds in tap water warmed to 60° C.

(3) lubrication treatment (contact step): the test piece washed with the water was immersed for 90 seconds in the lubricating coating agent for metal materials (see Tables 1 and 2), warmed to 60° C.

(4) drying: the test piece subjected to the lubrication treatment was dried for 3 minutes at 80° C.

<Step B>

(1) shot blasting: a test piece (metal material) was subjected to a shot blasting treatment for 5 minutes with the use of shot balls of φ0.5 mm (from SUS).

(2) water rinsing: the test piece subjected to shot blasting was immersed for 90 seconds in tap water warmed to 60° C.

(3) lubrication treatment (contact step): the test piece rinsed with the water was immersed for 90 seconds in the lubricating coating agent for metal materials (see Table 2), warmed to 60° C.

(4) drying: the test piece subjected to the lubrication treatment was dried for 3 minutes at room temperature (blowing).

<Step C (Cathode Electrolysis Treatment)>

(1) acid cleaning: a test piece (metal material) was immersed in 15% hydrochloric acid at room temperature for 15 minutes.

(2) water rinsing: the degreased test piece was immersed for 10 seconds in tap water warmed to 60° C.

(3) lubrication treatment (contact step): a cathode electrolysis treatment was carried out under the conditions of current density: 10 $A/dm^2$ and 60° C. for 5 seconds with the use of a commercially available rectifier (model BPS40-15 from Takasago Ltd.) with the test piece as a cathode and a lead plate for a counter electrode (anode).

(4) drying: the test piece subjected to the lubrication treatment was dried for 3 minutes at 80° C.

[Example Standards in the Case of Iron and Steel Material for Target Material]

TABLE 1

| composition of lubricating coating agent for metal material (1000 g in total) | | | | | | | | | |
|---|---|---|---|---|---|---|---|---|---|
| | | | lubricating component (solid lubricant/lipophilic lubricating component/carrier particle) | | | | | | |
| chemical conversion component | | | | | | blending | solid | binder component | |
| chemical conversion | blending amount | concentration | solid | lipophilic lubricating | inclusion amount | amount | content concentration | binder | blending amount |

TABLE 1-continued

| | component | (g) | (mass %) | lubricant | component | (mass %) | (g) | (mass %) | component | (g) |
|---|---|---|---|---|---|---|---|---|---|---|
| Example 1 | A-1 | 20 | 2 | B-5 | | 0.0 | 100 | 50 | D-1 | 75 |
| Example 2 | A-2 | 20 | 2 | B-5 | | 0.0 | 100 | 50 | D-1 | 75 |
| Example 3 | A-3 | 20 | 2 | B-5 | | 0.0 | 100 | 50 | D-1 | 75 |
| Example 4 | A-4 | 20 | 2 | B-5 | | 0.0 | 100 | 50 | D-1 | 75 |
| Example 5 | A-5 | 20 | 2 | B-5 | | 0.0 | 100 | 50 | D-1 | 75 |
| Example 6 | A-6 | 20 | 2 | B-5 | | 0.0 | 100 | 50 | D-1 | 75 |
| Example 7 | A-1 | 20 | 2 | B-19 | | 0.0 | 100 | 50 | D-1 | 75 |
| Example 8 | A-1 | 20 | 2 | B-20 | | 0.0 | 100 | 50 | D-1 | 75 |
| Example 9 | A-1 | 20 | 2 | | C-12 | 0.0 | 100 | 50 | D-1 | 75 |
| Example 10 | A-2 | 20 | 2 | | C-12 | 0.0 | 100 | 50 | D-1 | 75 |
| Example 11 | A-3 | 20 | 2 | | C-12 | 0.0 | 100 | 50 | D-1 | 75 |
| Example 12 | A-4 | 20 | 2 | | C-12 | 0.0 | 100 | 50 | D-1 | 75 |
| Example 13 | A-5 | 20 | 2 | | C-12 | 0.0 | 100 | 50 | D-1 | 75 |
| Example 14 | A-6 | 20 | 2 | | C-12 | 0.0 | 100 | 50 | D-1 | 75 |
| Example 15 | A-1 | 20 | 2 | | C-1 | 0.0 | 100 | 50 | D-1 | 75 |
| Example 16 | A-1 | 20 | 2 | | C-7 | 0.0 | 100 | 50 | D-1 | 75 |
| Example 17 | A-1 | 20 | 2 | | C-8 | 0.0 | 100 | 50 | D-1 | 75 |
| Example 18 | A-1 | 20 | 2 | | C-9 | 0.0 | 100 | 50 | D-1 | 75 |
| Example 19 | A-1 | 20 | 2 | | C-10 | 0.0 | 100 | 50 | D-1 | 75 |
| Example 20 | A-1 | 20 | 2 | | C-11 | 0.0 | 100 | 50 | D-1 | 75 |
| Example 21 | A-1 | 20 | 2 | | C-13 | 0.0 | 100 | 50 | D-1 | 75 |
| Example 22 | A-1 | 20 | 2 | | C-14 | 0.0 | 100 | 50 | D-1 | 75 |
| Example 23 | A-1 | 20 | 2 | B-5 | C-8 | 0.0 | 50 + 50 | 50 | D-1 | 75 |
| Example 24 | A-1 | 20 | 2 | B-5 | C-9 | 0.0 | 50 + 50 | 50 | D-1 | 75 |
| Example 25 | A-1 | 20 | 2 | B-19 | C-9 | 0.0 | 50 + 50 | 50 | D-1 | 75 |
| Example 26 | A-1 | 20 | 2 | B-20 | C-9 | 0.0 | 50 + 50 | 50 | D-1 | 75 |
| Example 27 | A-1 | 20 | 2 | B-5 | C-12 | 8.2 | 100 | 50 | D-1 | 75 |
| Example 28 | A-1 | 20 | 2 | B-5 | C-12 | 8.2 | 100 | 50 | D-2 | 75 |
| Example 29 | A-1 | 20 | 2 | B-5 | C-12 | 8.2 | 100 | 50 | D-3 | 75 |
| Example 30 | A-1 | 20 | 2 | B-5 | C-12 | 8.2 | 100 | 50 | D-4 | 187.5 |
| Example 31 | A-1 | 20 | 2 | B-5 | C-12 | 8.2 | 100 | 50 | D-5 | 187.5 |
| Example 32 | A-1 | 20 | 2 | B-5 | C-12 | 8.2 | 10 | 5 | D-1 | 165 |
| Example 33 | A-1 | 20 | 2 | B-5 | C-12 | 8.2 | 20 | 10 | D-1 | 155 |
| Example 34 | A-1 | 20 | 2 | B-5 | C-12 | 8.2 | 140 | 70 | D-1 | 35 |
| Example 35 | A-1 | 15 | 1.5 | B-5 | C-12 | 8.2 | 180 | 90 | D-1 | 0 |
| Example 36 | A-1 | 3 | 0.3 | B-5 | C-12 | 8.2 | 100 | 50 | D-1 | 92 |
| Example 37 | A-1 | 5 | 0.5 | B-5 | C-12 | 8.2 | 100 | 50 | D-1 | 90 |
| Example 38 | A-1 | 50 | 5 | B-5 | C-12 | 8.2 | 100 | 50 | D-1 | 45 |
| Example 39 | A-1 | 80 | 8 | B-5 | C-12 | 8.2 | 100 | 50 | D-1 | 15 |
| Example 40 | A-3 | 50 | 5 | B-5 | C-12 | 8.2 | 100 | 50 | D-1 | 45 |

| | composition of lubricating coating agent for metal material (1000 g in total) | | | | | | | | |
|---|---|---|---|---|---|---|---|---|---|
| | surfactant | | water | | total solid | | | | |
| | | blending | blending | | content | treat- | coating amount ($g/m^2$) | | |
| | surfactant | amount (g) | amount (g) | pH | concentration (mass %) | ment method | lower layer | upper layer | parameter |
| Example 1 | E-1 | 5 | 800 | 4.0 | 20 | Step A | 0.5 | 10 | only solid |
| Example 2 | E-1 | 5 | 800 | 4.0 | 20 | Step A | 1.5 | 10 | lubricant |
| Example 3 | E-1 | 5 | 800 | 4.0 | 20 | Step A | 1.6 | 10 | |
| Example 4 | E-1 | 5 | 800 | 4.0 | 20 | Step A | 0.5 | 10 | |
| Example 5 | E-1 | 5 | 800 | 4.0 | 20 | Step A | 0.5 | 10 | |
| Example 6 | E-1 | 5 | 800 | 4.0 | 20 | Step A | 0.5 | 10 | |
| Example 7 | E-1 | 5 | 800 | 4.0 | 20 | Step A | 0.5 | 10 | |
| Example 8 | E-1 | 5 | 800 | 4.0 | 20 | Step A | 0.5 | 10 | |
| Example 9 | E-1 | 5 | 800 | 4.0 | 20 | Step A | 0.5 | 10 | only lipophilic |
| Example 10 | E-1 | 5 | 800 | 4.0 | 20 | Step A | 1.5 | 10 | lubricating |
| Example 11 | E-1 | 5 | 800 | 4.0 | 20 | Step A | 1.6 | 10 | component |
| Example 12 | E-1 | 5 | 800 | 4.0 | 20 | Step A | 0.5 | 10 | |
| Example 13 | E-1 | 5 | 800 | 4.0 | 20 | Step A | 0.5 | 10 | |
| Example 14 | E-1 | 5 | 800 | 4.0 | 20 | Step A | 0.5 | 10 | |
| Example 15 | E-1 | 5 | 800 | 4.0 | 20 | Step A | 0.5 | 10 | |
| Example 16 | E-1 | 5 | 800 | 4.0 | 20 | Step A | 0.5 | 10 | |
| Example 17 | E-1 | 5 | 800 | 4.0 | 20 | Step A | 0.5 | 10 | |
| Example 18 | E-1 | 5 | 800 | 4.0 | 20 | Step A | 0.5 | 10 | |
| Example 19 | E-1 | 5 | 800 | 4.0 | 20 | Step A | 0.5 | 10 | |
| Example 20 | E-1 | 5 | 800 | 4.0 | 20 | Step A | 0.5 | 10 | |
| Example 21 | E-1 | 5 | 800 | 4.0 | 20 | Step A | 0.5 | 10 | |
| Example 22 | E-1 | 5 | 800 | 4.0 | 20 | Step A | 0.5 | 10 | |
| Example 23 | E-1 | 5 | 800 | 4.0 | 20 | Step A | 0.5 | 10 | solid lubricant + |
| Example 24 | E-1 | 5 | 800 | 4.0 | 20 | Step A | 0.5 | 10 | lipophilic |
| Example 25 | E-1 | 5 | 800 | 4.0 | 20 | Step A | 0.5 | 10 | lubricating |
| Example 26 | E-1 | 5 | 800 | 4.0 | 20 | Step A | 0.5 | 10 | component |
| Example 27 | E-1 | 5 | 800 | 4.0 | 20 | Step A | 0.5 | 10 | binder |

TABLE 1-continued

| | | | | | | | | | |
|---|---|---|---|---|---|---|---|---|---|
| Example 28 | E-1 | 5 | 800 | 4.0 | 20 | Step A | 0.5 | 10 | component |
| Example 29 | E-1 | 5 | 800 | 4.0 | 20 | Step A | 0.5 | 10 | |
| Example 30 | E-1 | 5 | 687.5 | 4.0 | 20 | Step A | 0.5 | 10 | |
| Example 31 | E-1 | 5 | 687.5 | 4.0 | 20 | Step A | 0.5 | 10 | |
| Example 32 | E-1 | 5 | 800 | 4.0 | 20 | Step A | 0.5 | 10 | lubricating |
| Example 33 | E-1 | 5 | 800 | 4.0 | 20 | Step A | 0.5 | 10 | component |
| Example 34 | E-1 | 5 | 800 | 4.0 | 20 | Step A | 0.5 | 10 | concentration |
| Example 35 | E-1 | 5 | 800 | 4.0 | 20 | Step A | 0.5 | 10 | |
| Example 36 | E-1 | 5 | 800 | 4.0 | 20 | Step A | 0.1 | 10 | chemical |
| Example 37 | E-1 | 5 | 800 | 4.0 | 20 | Step A | 0.3 | 10 | conversion |
| Example 38 | E-1 | 5 | 800 | 4.0 | 20 | Step A | 0.7 | 10 | concentration, |
| Example 39 | E-1 | 5 | 800 | 4.0 | 20 | Step A | 0.8 | 10 | lower layer |
| Example 40 | E-1 | 5 | 800 | 4.0 | 20 | Step A | 3.0 | 10 | coating amount |

[Example Standards in the Case of Iron and Steel Material for Target Material]

TABLE 2

| | composition of lubricating coating agent for metal material (1000 g in total) | | | | | | | | | | |
|---|---|---|---|---|---|---|---|---|---|---|---|
| | chemical conversion component | | | lubricating component 1 (carrier particle) | | | | | lubricating component 2 (lipophilic lubricating component) | | |
| | chemical conversion component | blending amount (g) | concentration (mass %) | solid lubricant | lipophilic lubricating component | inclusion amount (mass %) | blending amount (g) | solid content concentration (mass %) | lubricating component | blending amount (g) | solid content concentration (mass %) |
| Example 41 | A-1 | 20 | 2 | B-5 | C-12 | 8.2 | 100 | 50 | C-12 | 75 | 37.5 |
| Example 42 | A-2 | 20 | 2 | B-5 | C-12 | 8.2 | 100 | 50 | C-12 | 75 | 37.5 |
| Example 43 | A-3 | 20 | 2 | B-5 | C-12 | 8.2 | 100 | 50 | C-12 | 75 | 37.5 |
| Example 44 | A-4 | 20 | 2 | B-5 | C-12 | 8.2 | 100 | 50 | C-12 | 75 | 37.5 |
| Example 45 | A-5 | 20 | 2 | B-5 | C-12 | 8.2 | 100 | 50 | C-12 | 75 | 37.5 |
| Example 46 | A-6 | 20 | 2 | B-5 | C-12 | 8.2 | 100 | 50 | C-12 | 75 | 37.5 |
| Example 47 | A-1 | 20 | 2 | B-1 | C-12 | 4.3 | 100 | 50 | C-12 | 75 | 37.5 |
| Example 48 | A-1 | 20 | 2 | B-2 | C-12 | 5.0 | 100 | 50 | C-12 | 75 | 37.5 |
| Example 49 | A-1 | 20 | 2 | B-3 | C-12 | 8.0 | 100 | 50 | C-12 | 75 | 37.5 |
| Example 50 | A-1 | 20 | 2 | B-4 | C-12 | 8.2 | 100 | 50 | C-12 | 75 | 37.5 |
| Example 51 | A-1 | 20 | 2 | B-6 | C-12 | 8.1 | 100 | 50 | C-12 | 75 | 37.5 |
| Example 52 | A-1 | 20 | 2 | B-7 | C-12 | 8.1 | 100 | 50 | C-12 | 75 | 37.5 |
| Example 53 | A-1 | 20 | 2 | B-8 | C-12 | 8.1 | 100 | 50 | C-12 | 75 | 37.5 |
| Example 54 | A-1 | 20 | 2 | B-9 | C-12 | 6.4 | 100 | 50 | C-12 | 75 | 37.5 |
| Example 55 | A-1 | 20 | 2 | B-10 | C-12 | 5.1 | 100 | 50 | C-12 | 75 | 37.5 |
| Example 56 | A-1 | 20 | 2 | B-11 | C-12 | 4.1 | 100 | 50 | C-12 | 75 | 37.5 |
| Example 57 | A-1 | 20 | 2 | B-12 | C-12 | 8.2 | 100 | 50 | C-12 | 75 | 37.5 |
| Example 58 | A-1 | 20 | 2 | B-13 | C-12 | 8.1 | 100 | 50 | C-12 | 75 | 37.5 |
| Example 59 | A-1 | 20 | 2 | B-14 | C-12 | 8.1 | 100 | 50 | C-12 | 75 | 37.5 |
| Example 60 | A-1 | 20 | 2 | B-15 | C-12 | 8.0 | 100 | 50 | C-12 | 75 | 37.5 |
| Example 61 | A-1 | 20 | 2 | B-16 | C-12 | 7.8 | 100 | 50 | C-12 | 75 | 37.5 |
| Example 62 | A-1 | 20 | 2 | B-17 | C-12 | 8.7 | 100 | 50 | C-12 | 75 | 37.5 |
| Example 63 | A-1 | 20 | 2 | B-18 | C-12 | 4.8 | 100 | 50 | C-12 | 75 | 37.5 |
| Example 64 | A-1 | 20 | 2 | B-5 | C-1 | 8.2 | 100 | 50 | C-12 | 75 | 37.5 |
| Example 65 | A-1 | 20 | 2 | B-5 | C-2 | 8.2 | 100 | 50 | C-12 | 75 | 37.5 |
| Example 66 | A-1 | 20 | 2 | B-5 | C-3 | 7.2 | 100 | 50 | C-12 | 75 | 37.5 |
| Example 67 | A-1 | 20 | 2 | B-5 | C-4 | 4.9 | 100 | 50 | C-12 | 75 | 37.5 |
| Example 68 | A-1 | 20 | 2 | B-5 | C-5 | 8.2 | 100 | 50 | C-12 | 75 | 37.5 |
| Example 69 | A-1 | 20 | 2 | B-5 | C-6 | 8.1 | 100 | 50 | C-12 | 75 | 37.5 |
| Example 70 | A-1 | 20 | 2 | B-5 | C-7 | 8.0 | 100 | 50 | C-12 | 75 | 37.5 |
| Example 71 | A-1 | 20 | 2 | B-5 | C-8 | 8.0 | 100 | 50 | C-12 | 75 | 37.5 |
| Example 72 | A-1 | 20 | 2 | B-5 | C-9 | 8.1 | 100 | 50 | C-12 | 75 | 37.5 |
| Example 73 | A-1 | 20 | 2 | B-5 | C-10 | 8.1 | 100 | 50 | C-12 | 75 | 37.5 |
| Example 74 | A-1 | 20 | 2 | B-5 | C-11 | 8.0 | 100 | 50 | C-12 | 75 | 37.5 |
| Example 75 | A-1 | 20 | 2 | B-5 | C-13 | 8.0 | 100 | 50 | C-12 | 75 | 37.5 |
| Example 76 | A-1 | 20 | 2 | B-5 | C-14 | 8.1 | 100 | 50 | C-12 | 75 | 37.5 |
| Example 77 | A-1 | 20 | 2 | B-5 | C-12 | 8.2 | 100 | 50 | C-12 | 75 | 37.5 |
| Example 78 | A-1 | 20 | 2 | B-5 | C-12 | 8.2 | 100 | 50 | C-12 | 75 | 37.5 |
| Example 79 | A-1 | 20 | 2 | B-5 | C-12 | 8.2 | 100 | 50 | C-12 | 75 | 37.5 |
| Example 80 | A-1 | 20 | 2 | B-5 | C-12 | 8.2 | 100 | 50 | C-12 | 75 | 37.5 |
| Example 81 | A-1 | 3 | 0.3 | B-5 | C-12 | 8.2 | 100 | 50 | C-12 | 92 | 46 |
| Example 82 | A-1 | 5 | 0.5 | B-5 | C-12 | 8.2 | 100 | 50 | C-12 | 90 | 45 |
| Example 83 | A-1 | 50 | 5 | B-5 | C-12 | 8.2 | 100 | 50 | C-12 | 45 | 22.5 |
| Example 84 | A-1 | 80 | 8 | B-5 | C-12 | 8.2 | 100 | 50 | C-12 | 15 | 7.5 |
| Example 85 | A-3 | 50 | 5 | B-5 | C-12 | 8.2 | 100 | 50 | C-12 | 45 | 22.5 |

TABLE 2-continued

| | | | | | | | | | | | |
|---|---|---|---|---|---|---|---|---|---|---|---|
| Example 86 | A-1 | 20 | 2 | B-5 | C-12 | 8.2 | 100 | 50 | C-12 | 75 | 37.5 |
| Example 87 | A-1 | 20 | 2 | B-5 | C-12 | 8.2 | 100 | 50 | C-12 | 75 | 37.5 |
| Example 88 | A-1 | 20 | 2 | B-5 | C-12 | 8.2 | 100 | 50 | C-12 | 75 | 37.5 |
| Example 89 | A-1 | 20 | 2 | B-5 | C-12 | 8.2 | 100 | 50 | C-12 | 75 | 37.5 |
| Example 90 | A-1 | 6 | 0.6 | B-5 | C-12 | 8.2 | 10 | 37 | C-12 | 10 | 37 |
| Example 91 | A-1 | 6 | 0.6 | B-5 | C-12 | 8.2 | 11 | 37 | C-12 | 12 | 40 |
| Example 92 | A-1 | 10 | 1 | B-5 | C-12 | 8.2 | 30 | 50 | C-12 | 17.5 | 29.2 |
| Example 93 | A-1 | 20 | 2 | B-5 | C-12 | 8.2 | 150 | 50 | C-12 | 120 | 40 |
| Example 94 | A-1 | 20 | 2 | B-5 | C-12 | 8.2 | 200 | 50 | C-12 | 165 | 41.3 |
| Example 95 | A-1 | 20 | 2 | B-5 | C-12 | 8.2 | 100 | 50 | C-12 | 75 | 37.5 |
| Example 96 | A-2 | 20 | 2 | B-5 | C-12 | 8.2 | 100 | 50 | C-12 | 75 | 37.5 |
| Example 97 | A-1 | 20 | 2 | B-5 | C-12 | 8.2 | 100 | 50 | C-12 | 50 | 25 |
| Example 98 | A-1 | 20 | 2 | B-5 | C-12 | 8.2 | 100 | 50 | C-12 | 50 | 25 |
| Example 99 | A-1 | 20 | 2 | B-5 | C-12 | 8.2 | 100 | 50 | | | |
| Example 100 | A-1 | 20 | 2 | B-5 | C-12 | 8.2 | 100 | 50 | | | |

| | composition of lubricating coating agent for metal material (1000 g in total) | | | | | | | | | | | |
|---|---|---|---|---|---|---|---|---|---|---|---|---|
| | lubricating component 3 (solid lubricant) | | | surfactant | | water | | total solid | | | | |
| | solid lubricant | blending amount (g) | solid content concentration (mass %) | surfactant | blending amount (g) | blending amount (g) | pH | content concentration (mass %) | treatment method | coating amount ($g/m^2$) lower layer | coating amount ($g/m^2$) upper layer | parameter |
| Example 41 | | | | E-1 | 5 | 800 | 4.0 | 20 | Step A | 0.5 | 10 | chemical |
| Example 42 | | | | E-1 | 5 | 800 | 4.0 | 20 | Step A | 1.5 | 10 | conversion |
| Example 43 | | | | E-1 | 5 | 800 | 4.0 | 20 | Step A | 1.6 | 10 | component |
| Example 44 | | | | E-1 | 5 | 800 | 4.0 | 20 | Step A | 0.5 | 10 | |
| Example 45 | | | | E-1 | 5 | 800 | 4.0 | 20 | Step A | 0.5 | 10 | |
| Example 46 | | | | E-1 | 5 | 800 | 4.0 | 20 | Step A | 0.5 | 10 | |
| Example 47 | | | | E-1 | 5 | 800 | 4.0 | 20 | Step A | 0.5 | 10 | water contact |
| Example 48 | | | | E-1 | 5 | 800 | 4.0 | 20 | Step A | 0.5 | 10 | angle |
| Example 49 | | | | E-1 | 5 | 800 | 4.0 | 20 | Step A | 0.5 | 10 | |
| Example 50 | | | | E-1 | 5 | 800 | 4.0 | 20 | Step A | 0.5 | 10 | |
| Example 51 | | | | E-1 | 5 | 800 | 4.0 | 20 | Step A | 0.5 | 10 | Mohs hardness |
| Example 52 | | | | E-1 | 5 | 800 | 4.0 | 20 | Step A | 0.5 | 10 | average |
| Example 53 | | | | E-1 | 5 | 800 | 4.0 | 20 | Step A | 0.5 | 10 | particle size |
| Example 54 | | | | E-1 | 5 | 800 | 4.0 | 20 | Step A | 0.5 | 10 | |
| Example 55 | | | | E-1 | 5 | 800 | 4.0 | 20 | Step A | 0.5 | 10 | |
| Example 56 | | | | E-1 | 5 | 800 | 4.0 | 20 | Step A | 0.5 | 10 | |
| Example 57 | | | | E-1 | 5 | 800 | 4.0 | 20 | Step A | 0.5 | 10 | aspect ratio |
| Example 58 | | | | E-1 | 5 | 800 | 4.0 | 20 | Step A | 0.5 | 10 | |
| Example 59 | | | | E-1 | 5 | 800 | 4.0 | 20 | Step A | 0.5 | 10 | |
| Example 60 | | | | E-1 | 5 | 800 | 4.0 | 20 | Step A | 0.5 | 10 | |
| Example 61 | | | | E-1 | 5 | 800 | 4.0 | 20 | Step A | 0.5 | 10 | |
| Example 62 | | | | E-1 | 5 | 800 | 4.0 | 20 | Step A | 0.5 | 10 | |
| Example 63 | | | | E-1 | 5 | 800 | 4.0 | 20 | Step A | 0.5 | 10 | |
| Example 64 | | | | E-1 | 5 | 800 | 4.0 | 20 | Step A | 0.5 | 10 | lipophilic |
| Example 65 | | | | E-1 | 5 | 800 | 4.0 | 20 | Step A | 0.5 | 10 | lubricating |
| Example 66 | | | | E-1 | 5 | 800 | 4.0 | 20 | Step A | 0.5 | 10 | component |
| Example 67 | | | | E-1 | 5 | 800 | 4.0 | 20 | Step A | 0.5 | 10 | |
| Example 68 | | | | E-1 | 5 | 800 | 4.0 | 20 | Step A | 0.5 | 10 | |
| Example 69 | | | | E-1 | 5 | 800 | 4.0 | 20 | Step A | 0.5 | 10 | |
| Example 70 | | | | E-1 | 5 | 800 | 4.0 | 20 | Step A | 0.5 | 10 | |
| Example 71 | | | | E-1 | 5 | 800 | 4.0 | 20 | Step A | 0.5 | 10 | |
| Example 72 | | | | E-1 | 5 | 800 | 4.0 | 20 | Step A | 0.5 | 10 | |
| Example 73 | | | | E-1 | 5 | 800 | 4.0 | 20 | Step A | 0.5 | 10 | |
| Example 74 | | | | E-1 | 5 | 800 | 4.0 | 20 | Step A | 0.5 | 10 | |
| Example 75 | | | | E-1 | 5 | 800 | 4.0 | 20 | Step A | 0.5 | 10 | |
| Example 76 | | | | E-1 | 5 | 800 | 4.0 | 20 | Step A | 0.5 | 10 | |
| Example 77 | | | | E-1 | 5 | 800 | 2.0 | 20 | Step A | 0.2 | 10 | pH |
| Example 78 | | | | E-1 | 5 | 800 | 3.0 | 20 | Step A | 0.5 | 10 | |
| Example 79 | | | | E-1 | 5 | 800 | 6.0 | 20 | Step A | 0.5 | 10 | |
| Example 80 | | | | E-1 | 5 | 800 | 6.5 | 20 | Step A | 0.1 | 10 | |
| Example 81 | | | | E-1 | 5 | 800 | 4.0 | 20 | Step A | 0.1 | 10 | chemical conversion |
| Example 82 | | | | E-1 | 5 | 800 | 4.0 | 20 | Step A | 0.3 | 10 | component |
| Example 83 | | | | E-1 | 5 | 800 | 4.0 | 20 | Step A | 0.7 | 10 | concentration, |
| Example 84 | | | | E-1 | 5 | 800 | 4.0 | 20 | Step A | 0.8 | 10 | lower layer |
| Example 85 | | | | E-1 | 5 | 800 | 4.0 | 20 | Step A | 3.0 | 10 | coating amount |
| Example 86 | | | | E-1 | 5 | 800 | 2.0 | 20 | Step A | 0.1 | 10 | chemical conversion |
| Example 87 | | | | E-1 | 5 | 800 | 2.0 | 20 | Step A | 0.3 | 10 | treatment condition |
| Example 88 | | | | E-1 | 5 | 800 | 2.0 | 20 | Step A | 0.7 | 10 | (60° C.-11 to 300 |
| Example 89 | | | | E-1 | 5 | 800 | 2.0 | 20 | Step A | 0.8 | 10 | seconds) |
| Example 90 | | | | E-1 | 1 | 973 | 4.0 | 2.7 | Step A | 0.5 | 0.4 | upper layer |
| Example 91 | | | | E-1 | 1 | 970 | 4.0 | 3.0 | Step A | 0.5 | 0.5 | coating |

TABLE 2-continued

| | | | | | | | | | | | | |
|---|---|---|---|---|---|---|---|---|---|---|---|---|
| Example 92 | | | | E-1 | 2.5 | 940 | 4.0 | 6.0 | Step A | 0.5 | 3 | amount |
| Example 93 | | | | E-1 | 10 | 700 | 3.0 | 30 | Step A | 0.5 | 20 | |
| Example 94 | | | | E-1 | 15 | 800 | 3.0 | 40 | Step A | 0.5 | 40 | |
| Example 95 | | | | E-1 | 5 | 800 | 4.0 | 20 | Step B | 0.5 | 10 | |
| Example 96 | | | | E-1 | 5 | 800 | 4.0 | 20 | Step C | 2.0 | 10 | |
| Example 97 | B-19 | 25 | 12.5 | E-1 | 5 | 800 | 4.0 | 20 | Step A | 0.5 | 10 | others |
| Example 98 | B-20 | 25 | 12.5 | E-1 | 5 | 800 | 4.0 | 20 | Step A | 0.5 | 10 | |
| Example 99 | B-19 | 75 | 37.5 | E-1 | 5 | 800 | 4.0 | 20 | Step A | 0.5 | 10 | |
| Example 100 | B-20 | 75 | 37.5 | E-1 | 5 | 800 | 4.0 | 20 | Step A | 0.5 | 10 | |

[Example Standards in the Case of Aluminum Material and Magnesium for Target Materials]

TABLE 3

| | composition of lubricating coating agent for metal material (1000 g in total) | | | | | | | | | | |
|---|---|---|---|---|---|---|---|---|---|---|---|
| | chemical conversion component | | | lubricating component 1 (carrier particle) | | | | | lubricating component 2 | | |
| | chemical conversion component | blending amount (g) | concentration (mass %) | solid lubricant | lipophilic lubricating component | inclusion amount (mass %) | blending amount (g) | solid content concentration (mass %) | lubricating component | blending amount (g) | solid content concentration (mass %) |
| Example 1 | A-4 | 20 | 2 | B-5 | C-12 | 8.2 | 100 | 50 | C-12 | 75 | 37.5 |
| Example 2 | A-5 | 20 | 2 | B-5 | C-12 | 8.2 | 100 | 50 | C-12 | 75 | 37.5 |
| Example 3 | A-6 | 20 | 2 | B-5 | C-12 | 8.2 | 100 | 50 | C-12 | 75 | 37.5 |
| Example 4 | A-4 | 20 | 2 | B-5 | C-12 | 8.2 | 100 | 50 | C-12 | 75 | 37.5 |
| Example 5 | A-5 | 20 | 2 | B-5 | C-12 | 8.2 | 100 | 50 | C-12 | 75 | 37.5 |
| Example 6 | A-6 | 20 | 2 | B-5 | C-12 | 8.2 | 100 | 50 | C-12 | 75 | 37.5 |

| | composition of lubricating coating agent for metal material (1000 g in total) | | | | | | | | |
|---|---|---|---|---|---|---|---|---|---|
| | surfactant | | water | | total solid content | | coating amount (g/m²) | | |
| | surfactant | blending amount (g) | blending amount (g) | pH | concentration (mass %) | treatment method | lower layer | upper layer | target material |
| Example 1 | E-1 | 5 | 800 | 4.0 | 20 | Step A | 0.4 | 10 | aluminum |
| Example 2 | E-1 | 5 | 800 | 4.0 | 20 | Step A | 0.4 | 10 | |
| Example 3 | E-1 | 5 | 800 | 4.0 | 20 | Step A | 0.4 | 10 | |
| Example 4 | E-1 | 5 | 800 | 4.0 | 20 | Step A | 0.6 | 10 | magnesium |
| Example 5 | E-1 | 5 | 800 | 4.0 | 20 | Step A | 0.6 | 10 | |
| Example 6 | E-1 | 5 | 800 | 4.0 | 20 | Step A | 0.6 | 10 | |

[Comparative Example Standards in the Case of Iron and Steel Material for Target Material]

Comparative Example 1

<Zinc Phosphate Treatment+Reactive Soap Treatment>

(1) degreasing: a test piece (metal material) was immersed for 10 minutes in a commercially available degreasing agent (registered trademark: FINECLEANER E6400 from Nihon Parkerizing Co., Ltd., concentration: 20 g/L) warmed to 60° C.

(2) water rinsing: the degreased test piece was immersed for 30 seconds in tap water at room temperature.

(3) phosphate treatment: the test piece rinsed with the water was immersed for 10 minutes in a commercially available phosphate treatment solution (registered trademark: PALBOND 181X from Nihon Parkerizing Co., Ltd., concentration: 90 g/L) warmed to 80° C.

(4) water rinsing: the test piece subjected to the phosphate treatment was immersed for 30 seconds in tap water at room temperature.

(5) reactive soap treatment: the test piece rinsed with the water was immersed for 5 minutes in a commercially available reactive soap treatment solution (registered trademark: PALUBE 235 from Nihon Parkerizing Co., Ltd., concentration: 70 g/L) warmed to 80° C.

(6) drying: the test piece subjected to the reactive soap treatment was dried for 3 minutes at 80° C.

Comparative Example 2

The following lubricant (in accordance with Patent Literature 1: JP 51-94436 A) was prepared, and subjected to the lubrication treatment in accordance with the step A.

<Lubricant>

To 1 L of a phosphoric acid aqueous solution with a concentration of 20 wt %, 100 cc of ARON A10H (from TOAGOSEI CO., LTD., polyacrylic acid, solid content: 25%) was added, and furthermore, a pentaerythritol tallow fatty acid ester was emulsified and dispersed with a cationic surfactant so as to achieve an emulsion concentration of 5 wt % with respect to the phosphoric acid aqueous solution. The lubricant was 0.5 in pH. In accordance with the <step A> mentioned previously, only for lubrication treatment, an immersion treatment was carried out under the condition of 80° C. for 1 minute. The coating amount of the lowerchemical conversion coating was 0.08 g/m², whereas the coating amount of the upper lubricating coating was 10 g/m².

Comparative Examples 3 to 8

Lubricating coating agents according to comparative examples 3 to 8, shown in Tables 4 and 5 below, were prepared, and subjected to the lubricating treatment in accordance with the step A. The coating amount of the lower chemical conversion coating and the coating amount of the upper lubricating coating are supposed as shown in Tables 4 and 5.

TABLE 4

| | composition of lubricating coating agent for metal material (1000 g in total) | | | | | | | | | | |
|---|---|---|---|---|---|---|---|---|---|---|---|
| | chemical conversion component | | | lubricating component 1 (carrier particle) | | | | | lubricating component 2 (base component) | | |
| | chemical conversion component | blending amount (g) | concentration (mass %) | layered clay mineral | lipophilic lubricating component | inclusion amount (mass %) | blending amount (g) | solid content concentration (mass %) | lubricating component | blending amount (g) | solid content concentration (mass %) |
| Comparative Example 3 | A-1 | 20 | 2 | B-5 | C-12 | 8.2 | 100 | 50 | C-12 | 75 | 37.5 |
| Comparative Example 4 | A-1 | 20 | 2 | B-5 | C-12 | 8.2 | 100 | 50 | C-12 | 75 | 37.5 |
| Comparative Example 5 | A-1 | 2 | 0.2 | B-5 | C-12 | 8.2 | 100 | 50 | C-12 | 93 | 46.5 |
| Comparative Example 6 | A-1 | 90 | 9 | B-5 | C-12 | 8.2 | 90 | 50 | C-12 | 15 | 7.5 |
| Comparative Example 7 | A-1 | 20 | 2 | B-21 | C-12 | 8.2 | 100 | 50 | C-12 | 75 | 37.5 |

| | composition of lubricating coating agent for metal material (1000 g in total) | | | | total solid content | | coating amount ($g/m^2$) | | |
|---|---|---|---|---|---|---|---|---|---|
| | surfactant | | water | | | | | | |
| | surfactant | blending amount (g) | blending amount (g) | pH | concentration (mass %) | treatment method | lower layer | upper layer | parameter |
| Comparative Example 3 | E-1 | 5 | 800 | 1.8 | 20 | Step A | 0.09 | 10 | pH |
| Comparative Example 4 | E-1 | 5 | 800 | 6.8 | 20 | Step A | 0.05 | 10 | |
| Comparative Example 5 | E-1 | 5 | 800 | 4.0 | 20 | Step A | 0.08 | 10 | chemical conversion |
| Comparative Example 6 | E-1 | 5 | 800 | 4.0 | 20 | Step A | 0.8 | 10 | component concentration |
| Comparative Example 7 | E-1 | 5 | 800 | 4.0 | 20 | Step A | 0.5 | 10 | black base |

TABLE 5

| | composition of lubricating coating agent for metal material (1000 g in total) | | | | | | | | | |
|---|---|---|---|---|---|---|---|---|---|---|
| | chemical conversion component | | | lubricating component | | | | | binder component | |
| | chemical conversion component | blending amount (g) | concentration (mass %) | layered clay mineral | lipophilic lubricating component | inclusion amount (mass %) | blending amount (g) | solid content concentration (mass %) | binder component | blending amount (g) |
| Comparative Example 8 | A-1 | 20 | 2 | B-5 | C-12 | 8.2 | 8 | 4 | D-1 | 167 |

| | composition of lubricating coating agent for metal material (1000 g in total) | | | | | | | | |
|---|---|---|---|---|---|---|---|---|---|
| | surfactant | | water | | total solid content concentration (mass %) | treatment method | coating amount ($g/m^2$) | | |
| | surfactant | blending amount (g) | blending amount (g) | pH | | | lower layer | upper layer | parameter |
| Comparative Example 8 | E-1 | 5 | 800 | 4.0 | 20 | Step A | 0.5 | 10 | lubricating component concentration |

[Comparative Example Standards in the Case of Aluminum Material for Target Material]

Comparative Example 9

<Aluminum Fluoride Treatment+Reactive Soap Treatment>

(1) degreasing: a test piece (metal material) was immersed for 10 minutes in a commercially available degreasing agent (registered trademark: FINECLEANER E6400 from Nihon Parkerizing Co., Ltd., concentration: 20 g/L) warmed to 60° C.

(2) water rinsing: the degreased test piece was immersed for 30 seconds in tap water at room temperature.

(3) aluminum fluoride treatment: the test piece rinsed with the water was immersed for 2 minutes in a commercially available aluminum fluoride treatment solution (registered trademark: ALBOND A from Nihon Parkerizing Co., Ltd., concentration: 30 g/L) warmed to 90° C.

(4) water rinsing: the test piece subjected to the aluminum fluoride treatment was immersed for 30 seconds in tap water at room temperature.

(5) reactive soap treatment: the test piece rinsed with the water was immersed for 5 minutes in a commercially available reactive soap treatment solution (registered trademark: PALUBE 235 from Nihon Parkerizing Co., Ltd., concentration: 70 g/L) warmed to 80° C.

(6) drying: the test piece subjected to the reactive soap treatment was dried for 3 minutes at 80° C.

[Comparative Example Standards in the Case of Magnesium Material for Target Material]

Comparative Example 10

<Zinc Phosphate Treatment+Reactive Soap Treatment>

(1) degreasing: a test piece (metal material) was immersed for 10 minutes in a commercially available degreasing agent (registered trademark: FINECLEANER E6400 from Nihon Parkerizing Co., Ltd., concentration: 20 g/L) warmed to 60° C.

(2) water rinsing: the degreased test piece was immersed for 30 seconds in tap water at room temperature.

(3) phosphate treatment: the test piece rinsed with the water was immersed for 2 minutes in a commercially available phosphate treatment solution (registered trademark: PALBOND 181X from Nihon Parkerizing Co., Ltd., concentration: 90 g/L) warmed to 40° C.

(4) water rinsing: the test piece subjected to the phosphate treatment was immersed for 30 seconds in tap water at room temperature.

(5) reactive soap treatment: the test piece rinsed with the water was immersed for 5 minutes in a commercially available reactive soap treatment solution (registered trademark: PALUBE 235 from Nihon Parkerizing Co., Ltd., concentration: 70 g/L) warmed to 80° C.

(6) drying: the test piece subjected to the reactive soap treatment was dried for 3 minutes at 80° C.

[Evaluation Method]

Effects of the lubricating coating agent for metal material according to the present invention were verified by the following evaluations.

(1) lubricity (forgeability, wire drawability, tube drawability, slidability)

(2) corrosion resistance (3) operability (4) appearance

[Forgeability Test]

<Spike Test> test material: (1) iron and steel material; S45C material (25 mmφ×30 mm) subjected to spheroidizing annealing (2) aluminum material; A6061 (25 mmφ×30 mm)

(3) magnesium material; AZ31D (25 mmφ×30 mm)

test method: Test was carried out in accordance with the invention in JP 3227721 B2 for the evaluation. The lubricating coatings following protrusions of the test pieces were evaluated visually. In this test, in order to confirm whether the lubricity was decreased or not due to re-absorption of moisture by the lubricating coating, the lubricity was compared between a case of completely drying the lubricating coating under the condition of 80° C. for 3 minutes and a case of moisture absorption by the lubricating coating under the condition of 30° C. and relative humidity 80% for 5 hours after the complete drying. Here are evaluation criteria. It is to be noted that the level B or higher corresponds to a practical level.

Evaluation Criteria:

S: the coating which followed fully to the protrusion tip (almost no metallic luster)

A: the coating which followed to the protrusion tip

B: the coating which followed to the protrusion top

C: the coating which followed to the protrusion center

D: the coating which followed to the protrusion bottom

[Wire Drawability Test]

test material: iron and steel material; S45C, φ3.0 mm, 50000 mm in length test method: wire drawing was made under the condition of a reduction of area from 5 to 20% with the use of an R die. The limited reduction of area capable of stable wire drawing without any scratch or chatter was evaluated in accordance with the following evaluation criteria. It is to be noted that the level B or higher corresponds to a practical level.

Evaluation Criteria:

S: limited reduction of area of 23% or more

A: limited reduction of area of 20% or more and less than 23%

B: limited reduction of area of 15% or more and less than 20%

C: limited reduction of area of 10% or more and less than 15%

D: limited reduction of area of less than 10%

[Tube Drawability Test]

test material: iron and steel material; STKM17A, φ25.4 mm×2.5 mmt, 2000 mm in length test method: Test was carried out under the condition of tube drawing speed 20 m/min with the use of an R die and a cylindrical plug in a draw bench. The limited reduction of area capable of stable tube drawing without any scratch or chatter was evaluated in accordance with the following evaluation criteria. It is to be noted that the level B or higher corresponds to a practical level.

Evaluation Criteria:

S: limited reduction of area of 53% or more

A: limited reduction of area of 50% or more and less than 53%

B: limited reduction of area of 45% or more and less than 50%

C: limited reduction of area of 40% or more and less than 45%

D: limited reduction of area of less than 40%

[Slidability Test]

<Bowden Test> test material: (1) iron and steel material; SPCC-SD, 70 mm×150 mm×0.8 mmt (2) aluminum material; A6061 (25 mmφ×30 mm)

(3) magnesium material; AZ31D (25 mmφ×30 mm)

test method: a Bowden test was carried out mainly as performance evaluation of sliding coatings (in the case of a water-soluble inorganic salt, a water-soluble organic salt, or a water-based resin for the base component of the lubricating coating). This test is carried out by sliding a plate test piece with the lubricating coating formed, with the test piece in contact with a steel ball under constant load, and measuring the friction coefficient and the sliding frequency. When the coating was fractured, and then seizured, the friction coefficient reached 0.25, and thus, the slidability was evaluated with the sliding frequency achieved until the friction coefficient reached 0.25. It is to be noted that the level B or higher corresponds to a practical level in the following evaluation criteria.

test conditions:

load: 50 N indenter: 10 mmφSUJ2 steel ball sliding speed: 10 mm/s test temperature: 60° C.

evaluation criteria:

S: 250 times or more

A: 200 times or more, and less than 250 times

B: 150 times or more, and less than 200 times

C: 100 times or more, and less than 150 times

D: less than 100 times

[Comprehensive Evaluation of Lubricity]

The respective evaluation results for forgeability, wire drawability, tube drawability, and slidability were scored as follows, and the average value was regarded as a comprehensive evaluation result for lubricity. It is to be noted that whether the lubricity was practical or not was determined by the performance of B or higher (score of 3 or higher) in each lubricity evaluation and the average value of 3.0 or higher for the scores.

S=5, A=4, B=3, C=2, D=1

[Corrosion Resistance Test]

test material: (1) iron and steel material; SPCC-SD, 70 mm×150 mm×0.8 mmt (2) aluminum material; A6061 (25 mmφ×30 mm)

(3) magnesium material; AZ31D (25 mmφ×30 mm)

test method: for the corrosion resistance test, the plate test piece with the lubricating coating formed was left for 1 month in the plant in the Hiratsuka district, and evaluated with the rust area ratio. In the plant, the average temperature was 27.6° C., and the average humidity was 75%. It is to be noted that the level B or higher corresponds to a practical level in the following evaluation criteria.

Evaluation Criteria:

S: rust area ratio of 0% (no rust)

A: rust area ratio of less than 1% (excluding the rust area ratio of 0%)

B: rust area ratio of 1% or more and less than 10%

C: rust area ratio of 10% or more and less than 30%

D: rust area ratio of 30% or more and less than 80%

[Operability Evaluation]

The performance of line operation was evaluated by a treatment load test (sludge generation test). In this test, with respect to 1 L of the lubricating coating agent, a test material was continuously treated until reaching a treatment load of 0.3 $m^2$, and evaluated with the presence or absence of sludge generated. It is to be noted that the level B or higher corresponds to a practical level in the following evaluation criteria.

test material: (1) iron and steel material; SPCC-SD, 70 mm×150 mm×0.8 mmt (2) aluminum material; A6061 (25 mmφ×30 mm)

(3) magnesium material; AZ31D (25 mmφ×30 mm)

evaluation criteria:

A: no sludge generated

B: sludge slightly generated (generation amount: less than 3 g/L)

C: sludge generated (generation amount: 3 g/L or more)

[Appearance Evaluation]

The L value was measured as appearance evaluation after the formation of the lubricating coating.

test material: (1) iron and steel material; SPCC-SD, 70 mm×150 mm×0.8 mmt (2) aluminum material; A6061 (25 mmφ×30 mm)

(3) magnesium material; AZ31D (25 mmφ×30 mm)

measuring instrument: color computer SM-3 from Suga Test Instruments Co., Ltd.

evaluation criteria: here are evaluation criteria. The degree of blackness is higher as the L value is lower, which is determined to mean a worse working environment. The level B or higher corresponds to a practical level.

A: 70 or more

B: 50 or more, and less than 70

C: less than 50

Tables 6 to 9 show the evaluation results.

TABLE 6

| | lubricity test | | | | | | | | |
|---|---|---|---|---|---|---|---|---|---|
| | forgeability (spike test) | | | | | comprehensive | | | |
| | drying | moisture absorption | wire drawability | tube drawability | slidability | evaluation of lubricity | corrosion resistance | operability | appearance |
| Example 1 | A | A | A | B | A | 3.8 | A | A | A |
| Example 2 | A | A | A | B | A | 3.8 | B | B | A |
| Example 3 | A | A | A | B | A | 3.8 | B | A | A |
| Example 4 | A | B | A | B | B | 3.4 | S | A | A |
| Example 5 | A | B | B | B | B | 3.2 | B | B | A |
| Example 6 | A | B | B | B | B | 3.2 | B | B | A |
| Example 7 | A | B | B | B | B | 3.2 | B | A | A |
| Example 8 | B | B | B | B | B | 3.0 | B | A | A |
| Example 9 | A | A | A | B | A | 3.8 | A | A | A |
| Example 10 | A | A | A | B | A | 3.8 | B | B | A |
| Example 11 | A | A | A | B | A | 3.8 | B | A | A |
| Example 12 | A | B | B | B | B | 3.2 | S | A | A |
| Example 13 | B | B | B | B | B | 3.0 | B | B | A |
| Example 14 | B | B | B | B | B | 3.0 | B | B | A |
| Example 15 | A | B | A | B | B | 3.4 | A | A | A |
| Example 16 | A | B | A | B | B | 3.4 | A | A | A |
| Example 17 | A | A | A | B | A | 3.8 | A | A | A |
| Example 18 | A | A | A | B | A | 3.8 | A | A | A |
| Example 19 | A | B | A | B | B | 3.4 | A | A | A |
| Example 20 | A | A | A | B | A | 3.8 | A | A | A |
| Example 21 | A | A | A | B | A | 3.8 | A | A | A |
| Example 22 | A | A | A | B | A | 3.8 | A | A | A |
| Example 23 | A | A | A | A | A | 4.0 | A | A | A |
| Example 24 | A | A | A | A | A | 4.0 | A | A | A |
| Example 25 | A | B | A | A | A | 3.8 | A | A | A |
| Example 26 | A | B | A | B | A | 3.6 | A | A | A |
| Example 27 | S | A | S | S | S | 4.8 | S | A | A |
| Example 28 | S | A | S | S | S | 4.8 | S | A | A |
| Example 29 | S | A | S | A | S | 4.6 | S | A | A |
| Example 30 | S | A | S | A | S | 4.6 | S | A | A |
| Example 31 | S | A | S | A | S | 4.6 | S | A | A |
| Example 32 | S | A | S | A | A | 4.4 | S | A | A |
| Example 33 | S | S | S | S | A | 4.8 | S | A | A |
| Example 34 | S | S | S | S | A | 4.8 | S | A | A |
| Example 35 | S | S | S | S | A | 4.8 | S | A | A |
| Example 36 | A | A | B | B | B | 3.4 | B | A | A |
| Example 37 | S | S | S | S | A | 4.8 | A | A | A |
| Example 38 | S | S | S | S | A | 4.8 | S | A | A |
| Example 39 | S | S | S | S | A | 4.8 | S | B | A |
| Example 40 | 5 | S | S | S | A | 4.8 | A | A | A |

TABLE 7

| | lubricity test | | | | | | | | |
|---|---|---|---|---|---|---|---|---|---|
| | forgeability (spike test) | | | | | comprehensive | | | |
| | drying | moisture absorption | wire drawability | tube drawability | slidability | evaluation of lubricity | corrosion resistance | operability | appearance |
| Example 41 | S | S | S | S | A | 4.8 | S | A | A |
| Example 42 | S | S | S | S | A | 4.8 | B | B | A |
| Example 43 | S | S | S | S | A | 4.8 | B | A | A |
| Example 44 | S | A | S | A | A | 4.4 | S | A | A |
| Example 45 | A | A | A | A | A | 4.0 | B | B | A |
| Example 46 | A | A | A | B | A | 3.8 | B | B | A |
| Example 47 | A | A | A | A | B | 3.8 | A | A | A |
| Example 48 | S | A | A | A | A | 4.2 | A | A | A |
| Example 49 | S | A | S | A | A | 4.4 | S | A | A |
| Example 50 | S | A | S | S | A | 4.6 | S | A | A |
| Example 51 | S | A | A | A | A | 4.2 | A | A | A |
| Example 52 | S | S | S | S | A | 4.8 | S | A | A |
| Example 53 | S | S | S | S | A | 4.8 | S | A | A |

TABLE 7-continued

| | lubricity test | | | | | | | | |
|---|---|---|---|---|---|---|---|---|---|
| | forgeability (spike test) | | | | | comprehensive | | | |
| | drying | moisture absorption | wire drawability | tube drawability | slidability | evaluation of lubricity | corrosion resistance | operability | appearance |
| Example 54 | S | A | S | S | A | 4.6 | A | A | A |
| Example 55 | S | A | S | A | A | 4.4 | A | A | A |
| Example 56 | S | A | A | A | A | 4.2 | B | A | A |
| Example 57 | S | A | A | A | A | 4.2 | A | A | A |
| Example 58 | S | A | S | A | A | 4.4 | A | A | A |
| Example 59 | S | S | S | S | A | 4.8 | S | A | A |
| Example 60 | S | S | S | S | A | 4.8 | S | A | A |
| Example 61 | S | A | S | S | A | 4.6 | A | A | A |
| Example 62 | S | A | S | A | A | 4.4 | A | A | A |
| Example 63 | S | A | A | A | A | 4.2 | B | A | A |
| Example 64 | S | A | S | A | A | 4.4 | S | A | A |
| Example 65 | S | A | S | A | A | 4.4 | S | A | A |
| Example 66 | S | A | A | A | A | 4.2 | S | A | A |
| Example 67 | S | A | A | A | B | 4.0 | A | A | A |
| Example 68 | S | A | S | A | A | 4.4 | S | A | A |
| Example 69 | S | A | S | A | A | 4.4 | S | A | A |
| Example 70 | S | A | A | A | A | 4.2 | S | A | A |
| Example 71 | S | A | S | A | A | 4.4 | S | A | A |
| Example 72 | S | A | S | A | A | 4.4 | S | A | A |
| Example 73 | S | A | S | A | A | 4.4 | S | A | A |
| Example 74 | S | S | S | S | A | 4.8 | S | A | A |
| Example 75 | S | S | S | S | A | 4.8 | S | A | A |
| Example 76 | S | S | S | S | A | 4.8 | S | A | A |
| Example 77 | A | A | A | B | A | 3.8 | B | A | A |
| Example 78 | S | S | S | S | A | 4.8 | S | A | A |
| Example 79 | S | S | S | S | A | 4.8 | S | A | A |
| Example 80 | A | A | A | B | B | 3.6 | B | A | A |
| Example 81 | A | A | B | B | B | 3.4 | B | A | A |
| Example 82 | S | S | S | S | A | 4.8 | A | A | A |
| Example 83 | S | S | S | S | A | 4.8 | S | A | A |
| Example 84 | S | S | S | S | A | 4.8 | S | B | A |
| Example 85 | S | S | S | S | A | 4.8 | A | A | A |
| Example 86 | A | A | B | B | B | 3.4 | B | A | A |
| Example 87 | S | S | S | S | A | 4.8 | A | A | A |
| Example 88 | S | S | S | S | A | 4.8 | S | A | A |
| Example 89 | S | S | S | S | A | 4.8 | S | A | A |
| Example 90 | A | B | B | B | B | 3.2 | B | A | A |
| Example 91 | A | B | A | A | B | 3.6 | A | A | A |
| Example 92 | S | S | S | S | A | 4.8 | S | A | A |
| Example 93 | S | S | S | S | A | 4.8 | S | A | A |
| Example 94 | S | S | S | S | A | 4.8 | S | A | A |
| Example 95 | S | S | S | S | A | 4.8 | S | A | A |
| Example 96 | S | S | S | S | A | 4.8 | S | A | A |
| Example 97 | S | S | S | S | A | 4.8 | S | A | A |
| Example 98 | S | S | S | S | A | 4.8 | S | A | A |
| Example 99 | S | S | S | S | A | 4.8 | S | A | A |
| Example 100 | S | S | S | S | A | 4.8 | S | A | A |

TABLE 8

| | lubricity test | | | | | | | | |
|---|---|---|---|---|---|---|---|---|---|
| | forgeability (spike test) | | | | | comprehensive | | | |
| | drying | moisture absorption | wire drawability | tube drawability | slidability | evaluation of lubricity | corrosion resistance | operability | appearance |
| Example 101 | A | B | | | B | 3.3 | S | A | A |
| Example 102 | A | B | | | B | 3.3 | S | A | A |
| Example 103 | A | B | | | B | 3.3 | S | A | A |
| Example 104 | B | B | | | B | 3.0 | B | A | A |
| Example 105 | B | B | | | B | 3.0 | B | A | A |
| Example 106 | B | B | | | B | 3.0 | B | A | A |

TABLE 9

| | lubricity test | | | | | | | | |
|---|---|---|---|---|---|---|---|---|---|
| | forgeability (spike test) | | | | | comprehensive | | | |
| | drying | moisture absorption | wire drawability | tube drawability | slidability | evaluation of lubricity | corrosion resistance | operability | appearance |
| Comparative Example 1 | S | S | S | S | S | 5.0 | S | C | B |
| Comparative Example 2 | B | C | B | C | C | 2.4 | C | C | B |
| Comparative Example 3 | B | C | B | C | C | 2.4 | C | C | A |
| Comparative Example 4 | B | C | B | C | C | 2.4 | C | A | A |
| Comparative Example 5 | C | C | C | C | C | 2.0 | C | A | A |
| Comparative Example 6 | S | S | S | S | A | 4.8 | S | C | A |
| Comparative Example 7 | S | S | S | S | A | 4.8 | S | A | C |
| Comparative Example 8 | B | C | C | C | C | 2.2 | B | A | A |
| Comparative Example 9 | A | B | | | B | 3.3 | S | C | A |
| Comparative Example 10 | B | B | | | B | 3.0 | A | C | A |

As is clear from Tables 6 to 8, the water-based lubricating coating agents for metal materials according to the examples of the present invention have achieved performance at the practical level (rated as B or higher) in all of the evaluation tests. In contrast, as is clear from Table 9, comparative example 1 and comparative example 10 subjected to the phosphate+reactive soap treatment and comparative example 9 subjected to the aluminum fluoride+reactive soap treatment have achieved lubricity at the practical level, but have larger numbers of treatment steps as compared with the present invention, and also have operability rated as C. In addition, comparative examples 2 as prior art have created inferior results for all of lubricity, corrosion resistance, and operability, as compared with the lubricating coating agents according to the present invention.

On the other hand, comparative examples 3 to 6 and comparative example 8 with the pH of the lubricating coating agent, the chemical conversion concentration, and the lubricating component concentration outside the scope of the present invention have failed to reach the practical level in terms of at least one evaluation item of lubricity, corrosion resistance, and operability. Moreover, comparative example 7 with the use of molybdenum disulfide as a solid lubricant has achieved lubricity, corrosion resistance, and operability, at the practical levels, but an appearance rated as C. From the foregoing results, the present invention can be considered to have a greater deal of potential in industry, as compared with the prior art.

The invention claimed is:

1. A water-based lubricating coating agent for a metal material, the agent having pH of 2.0 to 6.5, which is obtained by blending:

at least one lubricating component, that is not a black-based solid lubricant, comprising carrier particles (C); and a chemical conversion component that comprises at least one of the group consisting of a primary sodium phosphate, oxalic acid, and ammonium molybdate, wherein a concentration of the lubricating component is 5 mass % or more in mass ratio to a total solid content mass in the lubricating coating agent, and a concentration of the chemical conversion component is 0.3 to 8 mass % when a total mass of the lubricating coating agent is regarded as 100 mass %, wherein the carrier particles (C) comprise a lipophilic lubricating component (A) and a cleavage solid lubricant (B), wherein the lipophilic lubricating component (A) comprises at least one of the group consisting of plant oil, mineral oil, and synthetic oil, wherein the cleavage solid lubricant (B) comprises a layered clay mineral (B2), wherein the layered clay mineral (B2) comprises at least one of the group consisting of kaolinite, talc, and mica, and is 30 μm or less in average particle size, and wherein the carrier particles (C) are particles that include the lipophilic lubricating component (A) between particles of and/or between layers of the layered clay mineral (B2).

2. The water-based lubricating coating agent for a metal material according to claim 1, wherein the lipophilic lubricating component has a solubility parameter (SP value) of 10 or less.

3. The water-based lubricating coating agent for a metal material according to claim 1, wherein the layered clay mineral is 40° or more in water contact angle.

4. The water-based lubricating coating agent for a metal material according to claim 1, wherein an aspect ratio is 3 to 150 in a cross section of the layered clay mineral.

5. The water-based lubricating coating agent for a metal material according to claim 1, wherein in the carrier particles, an inclusion amount of the lipophilic lubricating component is 5 mass % or more in mass ratio to a total mass of the carried particles.

6. The water-based lubricating coating agent for a metal material according to claim 1, wherein the layered clay mineral has Mohs hardness of 2 or less.

7. The water-based lubricating coating agent for a metal material according to claim 1, further comprising, as a binder component for a lubricating coating, at least one selected from the group consisting of a water-based inorganic salt, a water-based organic salt, and a water-based resin.

8. A surface-treated metal material, wherein a coating formed on a metal material surface by using the water-based lubricating coating agent for a metal material according to claim 1 comprises two layers of a chemical conversion coating on the metal material surface, and a lubricating coating on the chemical conversion coating, and as dried coating amounts, the chemical conversion coating for a lower layer is formed to be 0.1 $g/m^2$ or more, whereas the lubricating coating for an upper layer is formed to be 0.5 $g/m^2$ or more.

9. A method for forming a lubricating coating for a metal material, the method comprising a contact step of bringing a metal material into contact with the water-based lubricating coating agent for a metal material according to claim 1.

10. The water-based lubricating coating agent for a metal material according to claim 2, wherein the layered clay mineral is 40° or more in water contact angle.

11. The water-based lubricating coating agent for a metal material according to claim 2, wherein in the carrier particles, an inclusion amount of the lipophilic lubricating component is 5 mass % or more in mass ratio to a total mass of the carried particles.

12. The water-based lubricating coating agent for a metal material according to claim 2, further comprising, as a binder component for a lubricating coating, at least one selected from the group consisting of a water-based inorganic salt, a water-based organic salt, and a water-based resin.

* * * * *